US012203366B2

(12) United States Patent
Hitchcock et al.

(10) Patent No.: US 12,203,366 B2
(45) Date of Patent: Jan. 21, 2025

(54) COLLECTING SAMPLES FROM WELLBORES

(71) Applicant: Saudi Arabian Oil Company, Dhahran (SA)

(72) Inventors: Graham Hitchcock, Aberdeen (GB); Sakethraman Mahalingam, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/310,703

(22) Filed: May 2, 2023

(65) Prior Publication Data

US 2024/0368985 A1 Nov. 7, 2024

(51) Int. Cl.

| | |
|---|---|
| ***E21B 49/08*** | (2006.01) |
| ***E21B 37/02*** | (2006.01) |
| ***E21B 47/04*** | (2012.01) |
| ***E21B 47/06*** | (2012.01) |

(52) U.S. Cl.

CPC ..... *E21B 49/081* (2013.01); *E21B 37/02* (2013.01); *E21B 47/04* (2013.01); *E21B 47/06* (2013.01)

(58) Field of Classification Search

CPC ..... E21B 49/081; E21B 37/02; E21B 47/04; E21B 47/06

See application file for complete search history.

(56) References Cited

U.S. PATENT DOCUMENTS

| | | | |
|---|---|---|---|
| 381,374 | A | 4/1888 | Hine |
| 774,519 | A | 11/1904 | Greenaway |
| 891,957 | A | 6/1908 | Schubert |
| 2,043,225 | A | 6/1936 | Armentrout et al. |
| 2,110,913 | A | 3/1938 | Lowrey |
| 2,227,729 | A | 1/1941 | Lynes |
| 2,286,673 | A | 6/1942 | Douglas |
| 2,305,062 | A | 12/1942 | Church et al. |
| 2,344,120 | A | 3/1944 | Baker |

(Continued)

FOREIGN PATENT DOCUMENTS

| | | |
|---|---|---|
| AU | 2013206729 | 4/2015 |
| WO | WO 1992019838 | 11/1992 |

(Continued)

OTHER PUBLICATIONS

U.S. Appl. No. 16/524,935, filed Jul. 29, 2019, Zhan et al.

(Continued)

*Primary Examiner* — Crystal J Lee

(74) *Attorney, Agent, or Firm* — Fish & Richardson P.C.

(57) ABSTRACT

Systems and methods for collecting samples from a wellbore include a gauge cutter. The gauge cutter includes a body including a central recess in a downhole end of the body extending toward an uphole portion of the body, one or more large openings in the uphole portion of the body extending from an exterior of the body into the central recess, and a cutter blade disposed at the downhole end of the body. The gauge cutter further includes a fluid collection chamber disposed within the central recess and adjacent an interior surface of the body, a wiper blade disposed around an exterior of the body; and a plurality of passageways downhole and adjacent the wiper blade configured to allow fluid to pass from the exterior of the body into the fluid collection chamber.

20 Claims, 7 Drawing Sheets

(56) References Cited

U.S. PATENT DOCUMENTS 2,368,424 A 1/1945 Reistle
2,757,738 A 9/1948 Ritchey
2,509,608 A 5/1950 Penfield
2,688,369 A 9/1954 Broyles
2,690,897 A 10/1954 Clark
2,719,363 A 10/1955 Richard et al.
2,763,314 A 9/1956 Gill
2,782,857 A 2/1957 Clark et al.
2,784,787 A 3/1957 Matthews et al.
2,795,279 A 6/1957 Erich
2,799,641 A 7/1957 Gordon
2,805,045 A 9/1957 Goodwin
2,822,150 A 2/1958 Muse et al.
2,841,226 A 7/1958 Conrad et al.
2,890,752 A 6/1959 Cron et al.
2,899,000 A 8/1959 Medders et al.
2,927,775 A 3/1960 Hildebrandt
3,016,244 A 1/1962 Friedrich et al.
3,028,915 A 4/1962 Jennings
3,071,399 A 1/1963 Cronin
3,087,552 A 4/1963 Graham
3,093,192 A 6/1963 Allen
3,102,599 A 9/1963 Hillburn
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,220,478 A 11/1965 Kinzbach
3,228,470 A 1/1966 Papaila
3,236,307 A 2/1966 Brown
3,244,230 A 4/1966 Sharp
3,253,336 A 5/1966 Brown
3,268,003 A 8/1966 Essary
3,285,778 A 11/1966 Hauk
3,331,439 A 7/1967 Lawrence
3,369,605 A 2/1968 Donaldson et al.
3,386,514 A 6/1968 Weber
3,428,125 A 2/1969 Parker
3,468,373 A 9/1969 Smith
3,497,011 A 2/1970 Weber et al.
3,522,848 A 8/1970 New
3,547,192 A 12/1970 Claridge et al.
3,547,193 A 12/1970 Gill
3,572,431 A 3/1971 Zhou
3,601,197 A 8/1971 Ayers et al.
3,642,066 A 2/1972 Gill
3,656,550 A 4/1972 Wagner, Jr. et al.
3,656,564 A 4/1972 Brown
3,695,356 A 10/1972 Argabright et al.
3,696,866 A 10/1972 Dryden
3,839,791 A 10/1974 Feamster
3,862,662 A 1/1975 Kern
3,866,682 A 2/1975 Jones et al.
3,874,450 A 4/1975 Kern
3,882,937 A 5/1975 Robinson
3,931,856 A 1/1976 Barnes
3,937,283 A 2/1976 Blauer et al.
3,946,809 A 3/1976 Hagedorn
3,948,319 A 4/1976 Pritchett
3,980,136 A 9/1976 Plummer et al.
4,008,762 A 2/1977 Fisher et al.
4,010,799 A 3/1977 Kern et al.
4,044,833 A 8/1977 Volz
4,059,155 A * 11/1977 Greer ..... E21B 31/08 166/99
4,064,211 A 12/1977 Wood
4,084,637 A 4/1978 Todd
4,106,562 A 8/1978 Barnes et al.
4,129,437 A 12/1978 Taguchi et al.
4,135,579 A 1/1979 Rowland et al.
4,140,179 A 2/1979 Kasevich et al.
4,140,180 A 2/1979 Bridges et al.
4,144,935 A 3/1979 Bridges et al.
4,157,116 A 6/1979 Coulter
4,191,493 A 3/1980 Hansson et al.
4,193,448 A 3/1980 Jearnbey
4,193,451 A 3/1980 Dauphine
4,196,329 A 4/1980 Rowland et al.
4,199,025 A 4/1980 Carpenter
4,216,829 A 8/1980 Murphy
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,337,653 A 7/1982 Chauffe
4,340,405 A 7/1982 Steyert
4,343,651 A 8/1982 Yazu et al.
4,354,559 A 10/1982 Johnson
4,365,677 A 12/1982 Owens
4,373,581 A 2/1983 Toellner
4,394,170 A 7/1983 Sawaoka et al.
4,396,062 A 8/1983 Iskander
4,412,585 A 11/1983 Bouck
4,413,642 A 11/1983 Smith et al.
4,449,585 A 5/1984 Bridges et al.
4,457,365 A 7/1984 Kasevich et al.
4,464,993 A 8/1984 Porter
4,470,459 A 9/1984 Copland
4,476,926 A 10/1984 Bridges et al.
4,476,932 A 10/1984 Emery
4,484,627 A 11/1984 Perkins
4,485,868 A 12/1984 Sresty et al.
4,485,869 A 12/1984 Sresty et al.
4,487,257 A 12/1984 Dauphine
4,493,875 A 1/1985 Beck et al.
4,495,990 A 1/1985 Titus et al.
4,498,535 A 2/1985 Bridges
4,499,948 A 2/1985 Perkins
4,501,337 A 2/1985 Dickinson et al.
4,508,168 A 4/1985 Heeren
4,513,815 A 4/1985 Rundell et al.
4,515,212 A * 5/1985 Krugh ..... E21B 27/00 166/99
4,524,826 A 6/1985 Savage
4,524,827 A 6/1985 Bridges et al.
4,532,992 A 8/1985 Coenen et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,636,934 A 1/1987 Schwendemann
RE32,345 E 3/1987 Wood
4,660,636 A 4/1987 Rundell et al.
4,660,643 A 4/1987 Perkins
4,705,108 A 11/1987 Little et al.
4,705,113 A 11/1987 Perkins
4,787,456 A 11/1988 Jennings, Jr. et al.
4,817,711 A 4/1989 Jearnbey
4,836,284 A 6/1989 Tinker
4,846,277 A 7/1989 Khalil et al.
5,012,863 A 5/1991 Springer
5,018,578 A 5/1991 El Rabaa et al.
5,018,580 A 5/1991 Skipper
5,037,704 A 8/1991 Nakai et al.
5,055,180 A 10/1991 Klaila
5,068,819 A 11/1991 Misra et al.
5,069,283 A 12/1991 Mack
5,070,952 A 12/1991 Neff
5,074,355 A 12/1991 Lennon
5,082,054 A 1/1992 Kiamanesh
5,092,056 A 3/1992 Deaton
5,107,705 A 4/1992 Wraight et al.
5,107,931 A 4/1992 Valka et al.
5,228,518 A 7/1993 Wilson et al.

(56) References Cited

U.S. PATENT DOCUMENTS

| | | | |
|---|---|---|---|
| 5,236,039 | A | 8/1993 | Edelstein et al. |
| 5,238,067 | A | 8/1993 | Jennings, Jr. |
| 5,278,550 | A | 1/1994 | Rhein-Knudsen et al. |
| 5,387,776 | A | 2/1995 | Preiser |
| 5,388,648 | A | 2/1995 | Jordan, Jr. |
| 5,394,339 | A | 2/1995 | Jones |
| 5,394,942 | A | 3/1995 | Catania |
| 5,429,198 | A | 7/1995 | Anderson et al. |
| 5,490,598 | A | 2/1996 | Adams |
| 5,501,248 | A | 3/1996 | Kiest, Jr. |
| 5,523,158 | A | 6/1996 | Kapoor et al. |
| 5,529,123 | A | 6/1996 | Carpenter et al. |
| 5,595,252 | A | 1/1997 | O'Hanlon |
| 5,603,070 | A | 2/1997 | Cerutti et al. |
| 5,604,184 | A | 2/1997 | Ellis et al. |
| 5,613,555 | A | 3/1997 | Sorem et al. |
| 5,690,826 | A | 11/1997 | Cravello |
| 5,803,186 | A | 9/1998 | Berger et al. |
| 5,803,666 | A | 9/1998 | Keller |
| 5,813,480 | A | 9/1998 | Zaleski, Jr. et al. |
| 5,853,049 | A | 12/1998 | Keller |
| 5,890,540 | A | 4/1999 | Pia et al. |
| 5,899,274 | A | 5/1999 | Frauenfeld et al. |
| 5,912,219 | A | 6/1999 | Carrie et al. |
| 5,947,213 | A | 9/1999 | Angle |
| 5,955,666 | A | 9/1999 | Mullins |
| 5,958,236 | A | 9/1999 | Bakula |
| RE36,362 | E | 11/1999 | Jackson |
| 5,987,385 | A | 11/1999 | Varsamis et al. |
| 6,008,153 | A | 12/1999 | Kukino et al. |
| 6,012,526 | A | 1/2000 | Jennings et al. |
| 6,032,539 | A | 3/2000 | Liu |
| 6,032,742 | A | 3/2000 | Tomlin et al. |
| 6,041,860 | A | 3/2000 | Nazzal et al. |
| 6,047,239 | A | 4/2000 | Berger et al. |
| 6,096,436 | A | 8/2000 | Inspektor |
| 6,170,531 | B1 | 1/2001 | Jung et al. |
| 6,173,795 | B1 | 1/2001 | McGarian et al. |
| 6,189,611 | B1 | 2/2001 | Kasevich |
| 6,207,620 | B1 | 3/2001 | Gonzalez et al. |
| 6,250,387 | B1 | 6/2001 | Carmichael et al. |
| 6,254,844 | B1 | 7/2001 | Takeuchi et al. |
| 6,263,970 | B1 | 7/2001 | Blanchet |
| 6,268,726 | B1 | 7/2001 | Prammer |
| 6,269,953 | B1 | 8/2001 | Seyffert et al. |
| 6,287,079 | B1 | 9/2001 | Gosling et al. |
| 6,290,068 | B1 | 9/2001 | Adams et al. |
| 6,305,471 | B1 | 10/2001 | Milloy |
| 6,325,216 | B1 | 12/2001 | Seyffert et al. |
| 6,328,111 | B1 | 12/2001 | Bearden et al. |
| 6,330,913 | B1 | 12/2001 | Langseth et al. |
| 6,347,675 | B1 | 2/2002 | Kolle |
| 6,354,371 | B1 | 3/2002 | O'Blanc |
| 6,371,302 | B1 | 4/2002 | Adams et al. |
| 6,413,399 | B1 | 7/2002 | Kasevich |
| 6,419,730 | B1 | 7/2002 | Chavez |
| 6,443,228 | B1 | 9/2002 | Aronstam |
| 6,454,099 | B1 | 9/2002 | Adams et al. |
| 6,469,278 | B1 | 10/2002 | Boyce |
| 6,510,947 | B1 | 1/2003 | Schulte et al. |
| 6,534,980 | B2 | 2/2003 | Toufaily et al. |
| 6,544,411 | B2 | 4/2003 | Varandaraj |
| 6,561,269 | B1 | 5/2003 | Brown et al. |
| 6,571,877 | B1 | 6/2003 | Van Bilderbeek |
| 6,585,046 | B2 | 7/2003 | Neuroth et al. |
| 6,607,080 | B2 | 8/2003 | Winkler et al. |
| 6,612,384 | B1 | 9/2003 | Singh et al. |
| 6,622,554 | B2 | 9/2003 | Manke et al. |
| 6,623,850 | B2 | 9/2003 | Kukino et al. |
| 6,629,610 | B1 | 10/2003 | Adams et al. |
| 6,637,092 | B1 | 10/2003 | Menzel |
| 6,678,616 | B1 | 1/2004 | Winkler et al. |
| 6,722,504 | B2 | 4/2004 | Schulte et al. |
| 6,729,409 | B1 | 5/2004 | Gupta et al. |
| 6,741,000 | B2 | 5/2004 | Newcomb |
| 6,761,230 | B2 | 7/2004 | Cross et al. |
| 6,766,856 | B1 | 7/2004 | McGee |
| 6,776,231 | B2 | 8/2004 | Allen |
| 6,776,235 | B1 | 8/2004 | England |
| 6,814,141 | B2 | 11/2004 | Huh et al. |
| 6,827,145 | B2 | 12/2004 | Fotland et al. |
| 6,845,818 | B2 | 1/2005 | Tutuncu et al. |
| 6,850,068 | B2 | 2/2005 | Chernali et al. |
| 6,883,605 | B2 | 4/2005 | Arceneaux et al. |
| 6,895,678 | B2 | 5/2005 | Ash et al. |
| 6,912,177 | B2 | 6/2005 | Smith |
| 6,971,265 | B1 | 12/2005 | Sheppard et al. |
| 6,988,552 | B2 | 1/2006 | Wilson et al. |
| 6,993,432 | B2 | 1/2006 | Jenkins et al. |
| 7,000,777 | B2 | 2/2006 | Adams et al. |
| 7,001,872 | B2 | 2/2006 | Pyecroft et al. |
| 7,013,992 | B2 | 3/2006 | Tessari et al. |
| 7,040,395 | B2 | 5/2006 | Booth |
| 7,044,220 | B2 | 5/2006 | Nguyen et al. |
| 7,048,051 | B2 | 5/2006 | McQueen |
| 7,063,150 | B2 | 6/2006 | Slabaugh et al. |
| 7,063,155 | B2 | 6/2006 | Ruttley |
| 7,086,463 | B2 | 8/2006 | Ringgenberg et al. |
| 7,091,460 | B2 | 8/2006 | Kinzer |
| 7,109,457 | B2 | 9/2006 | Kinzer |
| 7,115,847 | B2 | 10/2006 | Kinzer |
| 7,124,819 | B2 | 10/2006 | Ciglenec et al. |
| 7,131,498 | B2 | 11/2006 | Campo et al. |
| 7,134,497 | B1 | 11/2006 | Chatterji et al. |
| 7,210,528 | B1 | 5/2007 | Brannon et al. |
| 7,216,767 | B2 | 5/2007 | Schulte et al. |
| 7,252,146 | B2 | 8/2007 | Slabaugh et al. |
| 7,255,169 | B2 | 8/2007 | van Batenburg et al. |
| 7,255,582 | B1 | 8/2007 | Liao |
| 7,281,580 | B2 | 10/2007 | Parker et al. |
| 7,281,581 | B2 | 10/2007 | Nyuyen et al. |
| 7,312,428 | B2 | 12/2007 | Kinzer |
| 7,322,776 | B2 | 1/2008 | Webb et al. |
| 7,331,385 | B2 | 2/2008 | Symington |
| 7,334,635 | B2 | 2/2008 | Nguyen |
| 7,334,636 | B2 | 2/2008 | Nguyen |
| 7,376,514 | B2 | 5/2008 | Habashy et al. |
| 7,387,174 | B2 | 6/2008 | Lurie |
| 7,395,878 | B2 | 7/2008 | Reitsma et al. |
| 7,422,060 | B2 | 9/2008 | Hammami et al. |
| 7,424,911 | B2 | 9/2008 | McCarthy et al. |
| 7,426,961 | B2 | 9/2008 | Stephenson et al. |
| 7,434,623 | B2 | 10/2008 | Gynz-Rekowski |
| 7,445,041 | B2 | 11/2008 | O'Brien |
| 7,451,812 | B2 | 11/2008 | Cooper et al. |
| 7,455,117 | B1 | 11/2008 | Hall et al. |
| 7,461,693 | B2 | 12/2008 | Considine et al. |
| 7,472,751 | B2 | 1/2009 | Brannon et al. |
| 7,484,561 | B2 | 2/2009 | Bridges |
| 7,516,787 | B2 | 4/2009 | Kaminsky |
| 7,539,548 | B2 | 5/2009 | Dhawan |
| 7,562,708 | B2 | 7/2009 | Cogliandro et al. |
| 7,571,767 | B2 | 8/2009 | Parker et al. |
| 7,581,590 | B2 | 9/2009 | Lesko et al. |
| 7,610,962 | B2 | 11/2009 | Fowler |
| 7,629,497 | B2 | 12/2009 | Pringle |
| 7,631,691 | B2 | 12/2009 | Symington et al. |
| 7,647,971 | B2 | 1/2010 | Kaminsky |
| 7,647,980 | B2 | 1/2010 | Corre et al. |
| 7,650,269 | B2 | 1/2010 | Rodney |
| 7,654,321 | B2 | 2/2010 | Zazovsky et al. |
| 7,677,317 | B2 | 3/2010 | Wilson |
| 7,677,673 | B2 | 3/2010 | Tranquilla et al. |
| 7,730,625 | B2 | 6/2010 | Blake |
| 7,735,548 | B2 | 6/2010 | Cherewyk |
| 7,767,628 | B2 | 8/2010 | Kippie et al. |
| 7,779,903 | B2 | 8/2010 | Bailey et al. |
| 7,789,148 | B2 | 9/2010 | Rayssiguier et al. |
| 7,803,740 | B2 | 9/2010 | Bicerano et al. |
| 7,828,057 | B2 | 11/2010 | Kearl et al. |
| 7,861,772 | B2 | 1/2011 | Blair |
| 7,909,096 | B2 | 3/2011 | Clark et al. |
| 7,918,277 | B2 | 4/2011 | Brannon et al. |
| 7,951,482 | B2 | 5/2011 | Ichinose et al. |

(56) References Cited

U.S. PATENT DOCUMENTS

| | | | |
|---|---|---|---|
| 7,980,392 | B2 | 7/2011 | Varco |
| 8,002,038 | B2 | 8/2011 | Wilson |
| 8,006,760 | B2 | 8/2011 | Fleming et al. |
| 8,066,068 | B2 | 11/2011 | Lesko et al. |
| 8,067,865 | B2 | 11/2011 | Savant |
| 8,096,349 | B2 | 1/2012 | Considine et al. |
| 8,100,190 | B2 | 1/2012 | Weaver |
| 8,104,537 | B2 | 1/2012 | Kaminsky |
| 8,119,576 | B2 | 2/2012 | Reyes et al. |
| 8,127,850 | B2 | 3/2012 | Brannon et al. |
| 8,176,977 | B2 | 5/2012 | Keller |
| 8,205,675 | B2 | 6/2012 | Brannon et al. |
| 8,210,256 | B2 | 7/2012 | Bridges et al. |
| 8,231,947 | B2 | 7/2012 | Vaidya et al. |
| 8,237,444 | B2 | 8/2012 | Simon |
| 8,245,792 | B2 | 8/2012 | Trinh et al. |
| 8,275,549 | B2 | 9/2012 | Sabag et al. |
| 8,286,734 | B2 | 10/2012 | Hannegan et al. |
| 8,408,305 | B2 | 4/2013 | Brannon et al. |
| 8,484,858 | B2 | 7/2013 | Brannigan et al. |
| 8,490,700 | B2 | 7/2013 | Lesko et al. |
| 8,511,404 | B2 | 8/2013 | Rasheed |
| 8,526,171 | B2 | 9/2013 | Wu et al. |
| 8,528,668 | B2 | 9/2013 | Rasheed |
| 8,550,174 | B1 | 10/2013 | Orgeron et al. |
| 8,567,491 | B2 | 10/2013 | Lurie |
| 8,584,755 | B2 | 11/2013 | Willberg et al. |
| 8,636,063 | B2 | 1/2014 | Ravi et al. |
| 8,636,065 | B2 | 1/2014 | Lesko et al. |
| 8,678,087 | B2 | 3/2014 | Schultz et al. |
| 8,683,859 | B2 | 4/2014 | Godager |
| 8,727,008 | B2 | 5/2014 | Krpec |
| 8,757,259 | B2 | 6/2014 | Lesko et al. |
| 8,763,699 | B2 | 7/2014 | Medvedev et al. |
| 8,776,609 | B2 | 7/2014 | Dria et al. |
| 8,794,062 | B2 | 8/2014 | DiFoggio et al. |
| 8,824,240 | B2 | 9/2014 | Roberts et al. |
| 8,884,624 | B2 | 11/2014 | Homan et al. |
| 8,925,213 | B2 | 1/2015 | Sallwasser |
| 8,936,083 | B2 | 1/2015 | Nguyen |
| 8,960,215 | B2 | 2/2015 | Cui et al. |
| 8,973,680 | B2 | 3/2015 | MacKenzie |
| 8,985,213 | B2 | 3/2015 | Saini et al. |
| 9,051,810 | B1 | 6/2015 | Cuffe et al. |
| 9,080,440 | B2 | 7/2015 | Panga et al. |
| 9,085,727 | B2 | 7/2015 | Litvinets et al. |
| 9,095,799 | B1 | 8/2015 | Packard |
| 9,097,094 | B1 | 8/2015 | Frost |
| 9,109,429 | B2 | 8/2015 | Xu et al. |
| 9,114,332 | B1 | 8/2015 | Liu |
| 9,181,789 | B2 | 11/2015 | Nevison |
| 9,217,291 | B2 | 12/2015 | Batarseh |
| 9,217,323 | B2 | 12/2015 | Clark |
| 9,222,350 | B2 | 12/2015 | Vaughn et al. |
| 9,238,953 | B2 | 1/2016 | Fleming et al. |
| 9,238,961 | B2 | 1/2016 | Bedouet |
| 9,250,339 | B2 | 2/2016 | Ramirez |
| 9,291,035 | B2 | 3/2016 | Cooper |
| 9,328,282 | B2 | 5/2016 | Li |
| 9,328,574 | B2 | 5/2016 | Sehsah |
| 9,353,589 | B2 | 5/2016 | Hekelaar |
| 9,355,440 | B1 | 5/2016 | Chen et al. |
| 9,394,782 | B2 | 7/2016 | DiGiovanni et al. |
| 9,435,159 | B2 | 9/2016 | Scott |
| 9,447,673 | B2 | 9/2016 | Medvedev et al. |
| 9,464,487 | B1 | 10/2016 | Zurn |
| 9,470,059 | B2 | 10/2016 | Zhou |
| 9,492,885 | B2 | 11/2016 | Zediker et al. |
| 9,494,010 | B2 | 11/2016 | Flores |
| 9,494,032 | B2 | 11/2016 | Roberson et al. |
| 9,523,268 | B2 | 12/2016 | Potapenko et al. |
| 9,528,366 | B2 | 12/2016 | Selman et al. |
| 9,562,987 | B2 | 2/2017 | Guner et al. |
| 9,567,819 | B2 | 2/2017 | Cavender et al. |
| 9,617,815 | B2 | 4/2017 | Schwartze et al. |
| 9,664,011 | B2 | 5/2017 | Kruspe et al. |
| 9,670,764 | B2 | 6/2017 | Lesko et al. |
| 9,702,211 | B2 | 7/2017 | Tinnen |
| 9,725,639 | B2 | 8/2017 | Vo et al. |
| 9,725,645 | B2 | 8/2017 | Monastiriotis et al. |
| 9,731,471 | B2 | 8/2017 | Schaedler et al. |
| 9,739,141 | B2 | 8/2017 | Zeng et al. |
| 9,757,796 | B2 | 9/2017 | Sherman et al. |
| 9,765,609 | B2 | 9/2017 | Chemali et al. |
| 9,777,562 | B2 | 10/2017 | Lastra et al. |
| 9,816,365 | B2 | 11/2017 | Nguyen et al. |
| 9,845,653 | B2 | 12/2017 | Hannegan et al. |
| 9,845,670 | B2 | 12/2017 | Surjaatmadja et al. |
| 9,863,230 | B2 | 1/2018 | Litvinets et al. |
| 9,863,231 | B2 | 1/2018 | Hull |
| 9,902,898 | B2 | 2/2018 | Nelson et al. |
| 9,903,010 | B2 | 2/2018 | Doud et al. |
| 9,909,404 | B2 | 3/2018 | Hwang et al. |
| 9,945,220 | B2 | 4/2018 | Saini et al. |
| 9,976,381 | B2 | 5/2018 | Martin et al. |
| 9,995,125 | B2 | 6/2018 | Madasu et al. |
| 10,000,983 | B2 | 6/2018 | Jackson et al. |
| 10,001,769 | B2 | 6/2018 | Huang et al. |
| 10,012,054 | B2 | 7/2018 | Ciglenec |
| 10,030,495 | B2 | 7/2018 | Litvinets et al. |
| 10,047,281 | B2 | 8/2018 | Nguyen et al. |
| 10,077,396 | B2 | 9/2018 | Nguyen et al. |
| 10,087,364 | B2 | 10/2018 | Kaufman et al. |
| 10,100,245 | B1 | 10/2018 | Bulekbay et al. |
| 10,113,406 | B1 | 10/2018 | Gomaa et al. |
| 10,113,408 | B2 | 10/2018 | Pobedinski et al. |
| 10,174,577 | B2 | 1/2019 | Leuchtenberg et al. |
| 10,208,239 | B2 | 2/2019 | Ballard |
| 10,233,372 | B2 | 3/2019 | Ramasamy et al. |
| 10,329,877 | B2 | 6/2019 | Simpson et al. |
| 10,352,125 | B2 | 7/2019 | Frazier |
| 10,392,910 | B2 | 8/2019 | Walton et al. |
| 10,394,193 | B2 | 8/2019 | Li et al. |
| 10,421,897 | B2 | 9/2019 | Skiba et al. |
| 10,450,839 | B2 | 10/2019 | Bulekbay et al. |
| 10,508,517 | B2 | 12/2019 | Bulekbay et al. |
| 10,544,640 | B2 | 1/2020 | Hekelaar |
| 10,550,314 | B2 | 2/2020 | Liang et al. |
| 10,551,800 | B2 | 2/2020 | Li et al. |
| 10,641,079 | B2 | 5/2020 | Aljubran et al. |
| 10,655,443 | B2 | 5/2020 | Gomma et al. |
| 10,673,238 | B2 | 6/2020 | Boone et al. |
| 10,836,956 | B2 | 11/2020 | Bulekbay et al. |
| 10,858,578 | B2 | 12/2020 | Bulekbay et al. |
| 10,883,042 | B2 | 1/2021 | Bulekbay |
| 10,920,516 | B2 | 2/2021 | Parker et al. |
| 10,927,618 | B2 | 2/2021 | Albahrani et al. |
| 10,995,263 | B2 | 5/2021 | Bulekbay et al. |
| 10,999,946 | B2 | 5/2021 | Li et al. |
| 11,008,816 | B2 | 5/2021 | Zhan et al. |
| 11,242,738 | B2 | 2/2022 | Bulekbay et al. |
| 2002/0043507 | A1 | 4/2002 | McCulloch |
| 2002/0066563 | A1 | 6/2002 | Langseth et al. |
| 2003/0052098 | A1 | 3/2003 | Kim et al. |
| 2003/0159776 | A1 | 8/2003 | Graham |
| 2003/0230526 | A1 | 12/2003 | Okabayshi et al. |
| 2004/0173244 | A1 | 9/2004 | Strothoff et al. |
| 2004/0182574 | A1 | 9/2004 | Adnan |
| 2004/0256103 | A1 | 12/2004 | Batarseh |
| 2004/0261999 | A1 | 12/2004 | Nguyen |
| 2005/0022987 | A1 | 2/2005 | Green et al. |
| 2005/0092523 | A1 | 5/2005 | McCaskill et al. |
| 2005/0097911 | A1 | 5/2005 | Revellat |
| 2005/0126784 | A1 | 6/2005 | Dalton |
| 2005/0137094 | A1 | 6/2005 | Weaver et al. |
| 2005/0194147 | A1 | 9/2005 | Metcalf et al. |
| 2005/0199386 | A1 | 9/2005 | Kinzer |
| 2005/0205266 | A1 | 9/2005 | Todd et al. |
| 2005/0259512 | A1 | 11/2005 | Mandal |
| 2006/0016592 | A1 | 1/2006 | Wu |
| 2006/0035808 | A1 | 2/2006 | Ahmed et al. |
| 2006/0073980 | A1 | 4/2006 | Brannon et al. |
| 2006/0076347 | A1 | 4/2006 | Kinzer |
| 2006/0102625 | A1 | 5/2006 | Kinzer |

(56) References Cited

U.S. PATENT DOCUMENTS

2006/0106541 A1 5/2006 Hassan et al.
2006/0144619 A1 7/2006 Storm
2006/0144620 A1 7/2006 Cooper
2006/0157249 A1 7/2006 Reynolds
2006/0185843 A1 8/2006 Smith
2006/0248949 A1 11/2006 Gregory et al.
2006/0249307 A1 11/2006 Ritter
2007/0000662 A1 1/2007 Symington et al.
2007/0012437 A1 1/2007 Clingman et al.
2007/0017669 A1 1/2007 Lurie
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0153626 A1 7/2007 Hayes et al.
2007/0175633 A1 8/2007 Kosmala
2007/0181301 A1 8/2007 O'Brien
2007/0187089 A1 8/2007 Bridges
2007/0193744 A1 8/2007 Bridges
2007/0204994 A1 9/2007 Wimmersperg
2007/0215355 A1 9/2007 Shapovalov
2007/0261844 A1 11/2007 Cogliandro et al.
2007/0289736 A1 12/2007 Kearl et al.
2008/0007421 A1 1/2008 Liu et al.
2008/0047337 A1 2/2008 Chemali et al.
2008/0053652 A1 3/2008 Corre et al.
2008/0073079 A1 3/2008 Tranquilla et al.
2008/0135242 A1 6/2008 Lesko
2008/0149329 A1 6/2008 Cooper
2008/0153718 A1 6/2008 Heidenfelder et al.
2008/0173443 A1 7/2008 Symington et al.
2008/0173480 A1 7/2008 Annaiyappa et al.
2008/0190822 A1 8/2008 Young
2008/0202764 A1 8/2008 Clayton et al.
2008/0223579 A1 9/2008 Goodwin
2008/0308282 A1 12/2008 Standridge et al.
2008/0312892 A1 12/2008 Heggemann
2009/0044945 A1 2/2009 Willberg et al.
2009/0139720 A1 6/2009 Frazier
2009/0151944 A1 6/2009 Fuller et al.
2009/0153354 A1 6/2009 Daussin
2009/0164125 A1 6/2009 Bordakov et al.
2009/0178809 A1 7/2009 Jeffryes et al.
2009/0183875 A1 7/2009 Rayssiguier et al.
2009/0255689 A1 10/2009 Kriesels et al.
2009/0259446 A1 10/2009 Zhang et al.
2009/0288820 A1 11/2009 Barron et al.
2009/0298720 A1 12/2009 Nguyen et al.
2010/0006339 A1 1/2010 Desai
2010/0043823 A1 2/2010 Lee
2010/0089583 A1 4/2010 Xu et al.
2010/0186955 A1 7/2010 Saasen et al.
2010/0276209 A1 11/2010 Yong et al.
2010/0282468 A1 11/2010 Willberg et al.
2010/0282511 A1 11/2010 Maranuk
2010/0323933 A1 12/2010 Fuller
2011/0005753 A1 1/2011 Todd et al.
2011/0011576 A1 1/2011 Cavender et al.
2011/0031026 A1 2/2011 Oxford et al.
2011/0058916 A1 3/2011 Toosky
2011/0120732 A1 5/2011 Lurie
2011/0155368 A1 6/2011 El-Khazindar
2011/0220416 A1 9/2011 Rives
2011/0247833 A1 10/2011 Todd et al.
2011/0251111 A1 10/2011 Lin et al.
2012/0012319 A1 1/2012 Dennis
2012/0018143 A1 1/2012 Lembcke
2012/0075615 A1 3/2012 Niclass et al.
2012/0097392 A1 4/2012 Reyes et al.
2012/0111578 A1 5/2012 Tverlid
2012/0112546 A1 5/2012 Culver
2012/0118571 A1* 5/2012 Zhou ..... E21B 31/08 166/99
2012/0125618 A1 5/2012 Willberg
2012/0132418 A1 5/2012 McClung
2012/0132468 A1 5/2012 Scott et al.
2012/0152543 A1 6/2012 Davis
2012/0169841 A1 6/2012 Chemali et al.
2012/0173196 A1 7/2012 Miszewski
2012/0181020 A1 7/2012 Barron et al.
2012/0186817 A1 7/2012 Gibson et al.
2012/0222854 A1 9/2012 McClung, III
2012/0227983 A1 9/2012 Lymberopoulos et al.
2012/0247764 A1 10/2012 Panga
2012/0273187 A1 11/2012 Hall
2012/0305247 A1 12/2012 Chen et al.
2012/0325564 A1 12/2012 Vaughn et al.
2013/0008653 A1 1/2013 Schultz et al.
2013/0008671 A1 1/2013 Booth
2013/0025943 A1 1/2013 Kumar
2013/0032549 A1 2/2013 Brown et al.
2013/0037268 A1 2/2013 Kleefisch et al.
2013/0068525 A1 3/2013 Digiovanni
2013/0076525 A1 3/2013 Vu et al.
2013/0125642 A1 5/2013 Parfitt
2013/0126164 A1 5/2013 Sweatman et al.
2013/0126169 A1 5/2013 Al-Nakhli et al.
2013/0146359 A1 6/2013 Koederitz
2013/0160992 A1 6/2013 Agrawal et al.
2013/0161003 A1 6/2013 Mikhailovich et al.
2013/0191029 A1 7/2013 Heck, Sr.
2013/0192839 A1 8/2013 Brown et al.
2013/0213637 A1 8/2013 Kearl
2013/0255936 A1 10/2013 Statoilydro et al.
2013/0260649 A1 10/2013 Thomson
2013/0269945 A1 10/2013 Mulholland et al.
2013/0308424 A1 11/2013 Kumar
2013/0312977 A1 11/2013 Lembcke
2013/0333892 A1 12/2013 McClung, IV
2013/0341027 A1 12/2013 Xu et al.
2014/0000899 A1 1/2014 Nevison
2014/0020708 A1 1/2014 Kim et al.
2014/0034144 A1 2/2014 Cui et al.
2014/0047776 A1 2/2014 Scott et al.
2014/0083771 A1 3/2014 Clark
2014/0090846 A1 4/2014 Deutch
2014/0131040 A9 5/2014 Panga
2014/0132468 A1 5/2014 Scott et al.
2014/0144633 A1 5/2014 Nguyen
2014/0144634 A1 5/2014 Nguyen
2014/0144635 A1 5/2014 Nguyen
2014/0183143 A1 7/2014 Cady et al.
2014/0202712 A1 7/2014 Fripp et al.
2014/0231068 A1 8/2014 Isaksen
2014/0231075 A1 8/2014 Springett et al.
2014/0231147 A1 8/2014 Bozso et al.
2014/0238658 A1 8/2014 Wilson et al.
2014/0246209 A1 9/2014 Themig et al.
2014/0246235 A1 9/2014 Yao
2014/0251593 A1 9/2014 Oberg et al.
2014/0251894 A1 9/2014 Larson et al.
2014/0265337 A1 9/2014 Harding et al.
2014/0270793 A1 9/2014 Bradford
2014/0278111 A1 9/2014 Gerrie et al.
2014/0290943 A1 10/2014 Ladva
2014/0291023 A1 10/2014 Edbury
2014/0296113 A1 10/2014 Reyes
2014/0300895 A1 10/2014 Pope et al.
2014/0326506 A1 11/2014 Difoggio
2014/0333754 A1 11/2014 Graves et al.
2014/0352954 A1 12/2014 Lakhtychkin et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.
2015/0027724 A1 1/2015 Symms
2015/0047846 A1 2/2015 Oort
2015/0071750 A1 3/2015 Foster
2015/0075714 A1 3/2015 Sun et al.
2015/0075797 A1 3/2015 Li
2015/0083420 A1 3/2015 Gupta et al.
2015/0083422 A1 3/2015 Pritchard
2015/0091737 A1 4/2015 Richardson et al.
2015/0101864 A1 4/2015 May

(56) References Cited

U.S. PATENT DOCUMENTS

2015/0129306 A1 5/2015 Coffman et al.
2015/0159467 A1 6/2015 Hartman et al.
2015/0211346 A1 7/2015 Potapenko
2015/0211362 A1 7/2015 Rogers
2015/0218439 A1 8/2015 Dean et al.
2015/0239795 A1 8/2015 Doud et al.
2015/0259593 A1 9/2015 Kaufman et al.
2015/0267500 A1 9/2015 Van Dongen
2015/0275644 A1 10/2015 Chen et al.
2015/0284833 A1 10/2015 Hsiao et al.
2015/0285026 A1 10/2015 Frazier
2015/0290878 A1 10/2015 Houben et al.
2015/0300151 A1 10/2015 Mohaghegh
2015/0345261 A1 12/2015 Kruspe et al.
2015/0369028 A1 12/2015 Potapenko
2016/0053572 A1 2/2016 Snoswell
2016/0053604 A1 2/2016 Abbassian
2016/0076357 A1 3/2016 Hbaieb
2016/0115783 A1 4/2016 Zeng et al.
2016/0130928 A1 5/2016 Torrione et al.
2016/0153240 A1 6/2016 Braga et al.
2016/0153274 A1 6/2016 Hull et al.
2016/0160106 A1 6/2016 Jamison et al.
2016/0194157 A1 7/2016 Senn et al.
2016/0208591 A1 7/2016 Weaver et al.
2016/0215205 A1 7/2016 Nguyen et al.
2016/0215604 A1 7/2016 Potapenko et al.
2016/0237810 A1 8/2016 Beaman et al.
2016/0247316 A1 8/2016 Whalley et al.
2016/0319189 A1 11/2016 Dusterhoft
2016/0339517 A1 11/2016 Joshi et al.
2016/0341019 A1 11/2016 Qiu et al.
2016/0347994 A1 12/2016 Purdy et al.
2016/0356125 A1 12/2016 Bello et al.
2016/0369154 A1 12/2016 Johnson et al.
2017/0051785 A1 2/2017 Cooper
2017/0058620 A1 3/2017 Torrione
2017/0066962 A1 3/2017 Ravi et al.
2017/0077705 A1 3/2017 Kuttel et al.
2017/0089153 A1 3/2017 Teodorescu
2017/0121593 A1 5/2017 Pantsurkin
2017/0138190 A1 5/2017 Elkatatny et al.
2017/0161885 A1 6/2017 Parmeshwar et al.
2017/0204703 A1 7/2017 Mair
2017/0234104 A1 8/2017 James
2017/0292376 A1 10/2017 Kumar et al.
2017/0314335 A1 11/2017 Kosonde et al.
2017/0314369 A1 11/2017 Rosano et al.
2017/0328196 A1 11/2017 Shi et al.
2017/0328197 A1 11/2017 Shi et al.
2017/0332482 A1 11/2017 Hauslmann
2017/0342776 A1 11/2017 Bullock et al.
2017/0350201 A1 12/2017 Shi et al.
2017/0350241 A1 12/2017 Shi
2018/0010030 A1 1/2018 Ramasamy et al.
2018/0010419 A1 1/2018 Livescu et al.
2018/0029942 A1 2/2018 Ishida
2018/0171772 A1 6/2018 Rodney
2018/0171774 A1 6/2018 Ringer et al.
2018/0177064 A1 6/2018 Van Pol et al.
2018/0187498 A1 7/2018 Soto et al.
2018/0202278 A1 7/2018 Nelson et al.
2018/0223624 A1 8/2018 Fripp et al.
2018/0230361 A1 8/2018 Foster
2018/0238133 A1 8/2018 Fripp et al.
2018/0240322 A1 8/2018 Potucek et al.
2018/0244981 A1 8/2018 Panga et al.
2018/0265416 A1 9/2018 Ishida et al.
2018/0266226 A1 9/2018 Batarseh et al.
2018/0315111 A1 11/2018 Alvo et al.
2018/0326679 A1 11/2018 Weisenberg et al.
2018/0328156 A1 11/2018 Slater
2018/0334612 A1 11/2018 Bulekbay et al.
2018/0334883 A1 11/2018 Williamson
2018/0363404 A1 12/2018 Faugstad
2018/0371860 A1 12/2018 Fripp et al.
2019/0009033 A1 1/2019 Butler et al.
2019/0049054 A1 2/2019 Gunnarsson et al.
2019/0055818 A1 2/2019 Bulekbay
2019/0078426 A1 3/2019 Zheng et al.
2019/0078626 A1 3/2019 Silsson
2019/0090056 A1 3/2019 Rexach et al.
2019/0090330 A1 3/2019 Aykroyd et al.
2019/0100988 A1 4/2019 Brian et al.
2019/0101872 A1 4/2019 Li
2019/0106959 A1 4/2019 Leonard et al.
2019/0145183 A1 5/2019 Potash
2019/0147125 A1 5/2019 Yu et al.
2019/0169953 A1 6/2019 Frazier
2019/0194519 A1 6/2019 Amanullah
2019/0218883 A1 7/2019 Inglis et al.
2019/0227499 A1 7/2019 Li et al.
2019/0257180 A1 8/2019 Kriesels et al.
2019/0264095 A1 8/2019 Qu et al.
2019/0267805 A1 8/2019 Kothuru et al.
2019/0282089 A1 9/2019 Wang
2019/0323320 A1 10/2019 Bulekbay et al.
2019/0323332 A1 10/2019 Cuellar et al.
2019/0345377 A1 11/2019 Haque et al.
2020/0003053 A1 1/2020 Pelletier et al.
2020/0032638 A1 1/2020 Ezzeddine
2020/0040680 A1 2/2020 Mhaskar et al.
2020/0081439 A1 3/2020 Mukherjee et al.
2020/0125040 A1 4/2020 Li et al.
2020/0157929 A1 5/2020 Torrione
2020/0182043 A1 6/2020 Downey et al.
2020/0190959 A1 6/2020 Gooneratne et al.
2020/0190963 A1 6/2020 Gooneratne et al.
2020/0190967 A1 6/2020 Gooneratne et al.
2020/0230524 A1 7/2020 Bulekbay et al.
2020/0240258 A1 7/2020 Stokely et al.
2020/0248546 A1 8/2020 Torrione et al.
2020/0368967 A1 11/2020 Zhan et al.
2020/0370381 A1 11/2020 Al-Rubaii et al.
2020/0371495 A1 11/2020 Al-Rubaii et al.
2021/0032934 A1 2/2021 Zhan et al.
2021/0032935 A1 2/2021 Zhan et al.
2021/0032936 A1 2/2021 Zhan et al.
2021/0034029 A1 2/2021 Zhan et al.
2021/0285306 A1* 9/2021 Al Mulhem ..... E21B 33/10
2021/0340866 A1 11/2021 Zhan et al.
2022/0018241 A1 1/2022 Affleck
2022/0025758 A1 1/2022 Mora et al.
2022/0213761 A1 7/2022 Bulekbay et al.
2022/0220827 A1 7/2022 Haugland et al.
2022/0250123 A1* 8/2022 Ahmari ..... B08B 9/0558

FOREIGN PATENT DOCUMENTS

WO WO 2006108161 10/2006
WO WO 2016108161 10/2006
WO WO 2009018536 2/2009
WO WO 2015012818 1/2015
WO WO 2015071750 5/2015
WO WO 2015072971 5/2015
WO WO 2015073001 5/2015
WO WO 2015095155 6/2015
WO WO 2015130419 9/2015
WO WO 2016032578 3/2016
WO WO 2017040553 3/2017
WO WO 2017132297 8/2017
WO WO 2017164878 9/2017
WO WO 2017196303 11/2017
WO WO 2018022198 2/2018
WO WO 2018046361 3/2018
WO WO 2018106121 6/2018

OTHER PUBLICATIONS

U.S Appl. No. 16/708,834, filed Dec. 10, 2019, Li et al.
U.S Appl. No. 16/708,865, filed Dec. 19, 2019, Li et al.
U.S Appl. No. 16/708,872, filed Dec. 10, 2019, Li et al.
U.S. Appl. No. 16/831,426, filed Mar. 26, 2020, Li et al.

(56) References Cited

OTHER PUBLICATIONS

U.S. Appl. No. 16/831,483, filed Mar. 26, 2020, Li et al.
U.S. Appl. No. 16/831,559, filed Mar. 26, 2020, Li et al.
U.S. Appl. No. 16/897,794, filed Jun. 2, 2020, Li et al.
U.S. Appl. No. 16/897,801, filed Jun. 10, 2020, Li et al.
U.S. Appl. No. 16/897,805, filed Jun. 10, 2020, Li et al.
U.S. Appl. No. 17/142,855, filed Jan. 6, 2021, Bulekbay et al.
"Gauge Ring Sample Catcher" LiMAR, available on or before Apr. 2014, 2 pages.
"Slickline Downhole Basic Tools Data Sheets" ELAA Dynamics, 2018, 34 pages.
"TervAlloy Degradable Magnesium Alloys," Terves Engineered Response, Engineered for Enhanced Completion Efficiency, Feb. 2018, 8 pages.
"Wireline & Flow Control Products" Elmar Tools, available on or before Jun. 21, 2021, 6 pages.
Alipour-Kivi et al., "Automated Liquid Unloading in Low-Pressure Gas Wells Using Intermittent and Distributed Heating of Wellbore Fluid," SPE 100650, Society of Petroleum Engineers (SPE), presented at the SPE Western Regional/AAPG Pacific Section/GSA Cordilleran Section Joint Meeting, 2006, 6 pages.
Corona et al., "Novel Washpipe-Free ICD Completion With Dissolvable Material, " OTC-28863-MS, Offshore Technology Conference (OTC), presented at the Offshore Technology Conference, Apr. 30-May 3, 2018, 10 pages.
Gil et al., "Wellbore Cooling as a Means to Permanently Increase Fracture Gradient, " SPE Annual Technical Conference and Exhibition, San Antonio, Texas, Sep. 24-27, 2006, published Jan. 1, 2006, 7 pages.
Gillard et al., "A New Approach to Generating Fracture Conductivity," SPE-135034-MS, Society of Petroleum Engineers (SPE), presented at the SPE Annual Technical Conference and Exhibition held in Florence, Italy, Sep. 20-22, 2010, 14 pages.
Gomaa et al., "Acid Fracturing: The Effect of Formation Strength on Fracture Conductivity," SPE 119623, Society of Petroleum Engineers (SPE), presented at the SPE Hydraulic Fracturing Technology Conference, Jan. 2009, 17 pages.
Gomaa et al., "Computational Fluid Dynamics Applied to Investigate Development and Optimization of Highly Conductive Channels within the Fracture Geometry," SPE-179143-MS, Society of Petroleum Engineers (SPE), presented at the SPE Hydraulic Fracturing Technology Conference, Texas, Feb. 9-11, 2016, 18 pages.
Gomaa et al., "Improving Fracture Conductivity by Developing and Optimizing a Channels Within the Fracture Geometry: CFD Study," SPE-178982-MS, Society of Petroleum Engineers (SPE), presented at the SPE International conference on Formation Damage Control in Layfayette, Feb. 24-26, 2016, 25 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
Kern et al., "Propping Fractures with Aluminum Particles," SPE-1573-G-PA, Society of Petroleum Engineers (SPE), Journal of Petroleum Technology, Jun. 1961, 13(6): 583-589, 7 pages.
King et al., "Atomic layer deposition of TiO2 films on particles in a fluidized bed reactor," Power Technology, 183:3, Apr. 2008, 8 pages.
Masa and Kuba, "Efficient use of compressed air for dry ice blasting," Journal of Cleaner Production, 111:A, Jan. 2016, 9 pages.
Mayerhofer et al., "Proppants? We Don't Need No. Proppants," SPE-38611, Society of Petroleum Engineers (SPE), presented at the SPE Annual Technical Conference and Exhibition, 457-464, Oct. 5, 1997, 8 pages.
Mueller et al., "Stimulation of Tight Gas Reservoir using coupled Hydraulic and CO2 Cold-frac Technology," SPE 160365, Society of Petroleum Engineers (SPE), presented at the SPE Asia Pacific Oil and Gas Conference and Exhibition, Oct. 22-24, 2012, 7 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 Hydraulic Fracturing Technology Conference, College Station, Texas, Jan. 29-31, 2007, 13 pages.
Praxair, "Carbon Dioxide, Solid or Dry Ice, Safety Data Sheet P-4575," Praxair, Jan. 1, 1997, 7 pages.
Princeton.edu [online], "Bernoulli's Equation," available on or before Jul. 24, 1997, via Internet Archive: Wayback Machine URL <https://www.princeton.edu/~asmits/Bicycle_web/Bernoulli.html>, 5 pages.
Ranjbar, "Cutting Transport in Inclined and Horizontal Wellbore," University of Stavanger, Faculty of Science and Technology, Master's Thesis, Jul. 6, 2010, 137 pages.
Rasi, "Hole Cleaning in Large, High-Angle Wellbores," IADC/SPE 27464, Society of Petroleum Engineers (SPE), presented at the 1994 SPE/IADC Drilling Conference, Feb. 15-18, 1994, 12 pages.
Singh et al., "Introduction to an Effective Workover Method to Repair Causing Leak," SPE-194654-MS, Society of Petroleum Engineers (SPE), presented at the SPE Oil and Gas India Conference and Exhibition, Apr. 9-11, 2019, 7 pages.
Soreide et al., "Estimation of reservoir stress effects due to injection of cold fluids: an example from NCS," ARMA 14-7394, American Rock Mechanics Association, presented at the 48th US Rock mechanics/Geomechanics Symposium, Jun. 1-4, 2014, 7 pages.
Takahashi et al., "Degradation Study on Materials for Dissolvable Frac Plugs," URTEC-2901283-MS, Unconventional Resources Technology Conference (URTC), presented at the SPE/AAPG/SEG Unconventional Resources Technology Conference, Jul. 23-25, 2018, 9 pages.
Tinsley and Williams, "A new method for providing increased fracture conductivity and improving stimulation results," SPE-4676-PA, Society of Petroleum Engineers (SPE), Journal of Petroleum Technology, 27(11): 1317-1325, 1975, 7 pages.
Van Poollen et al., "Hydraulic Fracturing—Fracture Flow Capacity vs Well Productivity," SPE-890-G, Society of Petroleum Engineers (SPE), Petroleum Transactions AIME, 213: 91-95, 1958, 5 pages.
Van Poollen, "Productivity vs Permeability Damage in Hydraulically Produced Fractures," SPE-906-2-G, Society of Petroleum Engineers (SPE), presented at Drilling and Production Practice, New York, New York, Jan. 1957, 8 pages.
Vincent, "Examining our Assumptions—Have oversimplifications jeopardized our ability to design optimal fracture treatments," SPE-119143-MS, Society of Petroleum Engineers (SPE), presented at the SPE Hydraulic Fracturing Technology Conference, The Woodlands, Jan. 19-21, 2009, 51 pages.
Vincent, "Five Things you Didn't Want to Know about Hydraulic Fractures," ISRM-ICHF-2013-045, presented at the International Conference for Effective and Sustainable Hydraulic Fracturing, an ASRM specialized Conference, Australia, May 20-22, 2013, 14 pages.
Weinstein, "Cold Waterflooding a Warm Reservoir," SPE 5083, Society of Petroleum Engineers (SPE), presented at the 49th Annual Fall Meeting of the Society of Petroleum Engineers of AIME, Oct. 6-9, 1974, 16 pages.
Williams et al., "Acidizing Fundamentals," Society of Petroleum Engineers of AIME, Jan. 1979, 131 pages.
Yu et al., "Chemical and Thermal Effects on Wellbore Stability of Shale Formations," SPE 71366, Society of Petroleum Engineers (SPE), presented at the 2001 SPE Annual Technical Conference and Exhibition, Sep. 30-Oct. 3, 2001, 11 pages.

* cited by examiner

COLLECTING SAMPLES FROM WELLBORES

TECHNICAL FIELD

The present disclosure relates to a wellbore tool for gauging a wellbore and collecting samples in the wellbore.

BACKGROUND

Gauge cutters are commonly used in the petroleum industry for ensuring accessibility of tubing/casing/liner prior to running any other sub-surface tools inside the well. A gauge cutter is a tool with a round, open-ended bottom which is milled to an accurate size. Large openings above the bottom of the tool allow for fluid bypass while running in the hole. Often a gauge cutter will be the first tool run on a slickline operation. A gauge cutter can also be used to remove light paraffin that may have built up in the casing and drift runs also. In the case of a restriction caused by scale, debris, or paraffin, the nature of the debris can be identified such that a treatment solution can be defined and implemented. To identify the debris a sample of the debris cut from the internal diameter of the wellbore by the gauge cutter can be retrieved by an additional run of a debris catcher tool (e.g., a sand bailer tool) for analysis.

SUMMARY

This disclosure describes systems and methods for collecting samples from a wellbore while running a gauge cutter through the wellbore. In some wells (e.g., gas wells), liquid condensation can build up on the interior walls of the wellbore/production tubing. As the gas flow decreases, for example due to production of gas from the well, the gas no longer has enough energy to lift heavier liquids (e.g., water and longer chain molecules such as heptanes (C7) and larger molecules) to the surface. The mist-like drops of heavier fluids can coalesce together and form droplets on the inner diameter of tubing and/or accumulate at the bottom of the well. The condensation of heavier hydrocarbons and water on the inner wall of the wellbore can pose a problem for depleting gas wells. Often, there is no quantification of the extent and nature of condensation in correlation with depth because the condensate is not preserved in its original condition by the time logging tools are run. Often the condensate is disturbed (e.g., by a conventional gauge cutter) before appropriate logging tools for sampling or analysis are run in the wellbore. The systems and methods of this disclosure provide a way to form a clear path through the wellbore while collecting samples of the condensate during the first run of a tool in the wellbore. The systems and methods of this disclosure also provide a way of sampling solid debris from the wellbore as the tool is pulled out of the wellbore.

In one aspect, a gauge cutter includes a body including a central recess in a downhole end of the body extending toward an uphole portion of the body; one or more large openings in the uphole portion of the body extending from an exterior of the body into the central recess; a cutter blade disposed at the downhole end of the body; a fluid collection chamber disposed within the central recess and adjacent an interior surface of the body; a wiper blade disposed around an exterior of the body; and a plurality of passageways downhole and adjacent the wiper blade configured to allow fluid to pass from the exterior of the body into the fluid collection chamber.

In one aspect, a method of collecting samples from a wellbore includes moving a gauge cutter in a downhole direction in the wellbore; wiping, by a wiper blade of the gauge cutter, condensate from interior walls of the wellbore; collecting samples of the condensate in a condensate collection chamber of the gauge cutter; moving the gauge cutter in an uphole direction in the wellbore; and collecting samples of solid debris from the wellbore in a solids collection chamber of the gauge cutter.

Embodiments of these aspects can include one or more of the following features.

In some embodiments, these aspects further include a solid debris sample collector disposed within the central recess.

In some embodiments, these aspects further include a removable core with an upper seal and a lower seal.

In some embodiments, an annular space between the removable core, the upper seal, the lower seal, and the interior surface of the body define the fluid collection chamber.

In some embodiments, these aspects further include a liquid collecting sponge. In some cases, the liquid collecting sponge includes an oil wettable sponge.

In some embodiments, these aspects further include a sensor module comprising an annular housing and positioned adjacent the fluid collection chamber. In some cases, the sensor module includes at least one of a fluid detection sensor, a water-cut sensor, a depth sensor, and a pressure sensor. In some cases, the sensor module is configured to allow collection of fluid in the fluid collection chamber based on a sensed pressure or depth in a wellbore.

In some embodiments, the wiper includes an elastomeric material.

In some embodiments, the plurality of passageways includes capillary tubes.

In some embodiments, these aspects include removing the solid collection chamber and the condensation collection chamber from the gauge cutter to access the collected samples.

In some embodiments, these aspects further include measuring at least one of a pressure, a depth, and a presence of a liquid in the wellbore by a sensing module of the gauge cutter.

In some cases, collecting samples of the condensate occurs after the sensing module measures a pre-defined pressure or depth in the wellbore.

In some embodiments, while moving the gauge cutter in the downhole direction, solid debris passes through the gauge cutter without being collected.

In some embodiments, wiping includes condensate pooling on a downhole side of the wiper blade.

In some embodiments, collecting samples of the condensate includes condensate flowing through a plurality of passageways of the gauge cutter from an exterior of the gauge cutter into the condensate collection chamber.

In some cases, these aspects further include retaining condensate in a liquid catching sponge disposed within the condensate collection chamber.

In some embodiments, these aspects further include collecting a sample of liquid located at a bottom of the wellbore.

Certain implementations can have particular advantages. The systems and methods of this disclosure combine sampling liquid and solid debris from a wellbore along with a gauge cutter run. Since the gauge cutter is the first tool to be run in the wellbore, the liquid sample catcher can collect samples of the liquid from the well in an undisturbed condition. Combining the sample collection with the gauge cutter tool avoids using a separate logging tool on a subsequent run to collect debris or liquid samples. Samples collected using the systems and methods of this disclosure can provide insight on the behavior of a particular reservoir or well. For example, the samples can provide insight on changes in produced gas composition, and/or indications of scaling or corrosion that can be expected in the well.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes systems and methods for collecting samples from a wellbore while running a gauge cutter through the wellbore. In some wells (e.g., gas wells), liquid condensation can build up on the interior walls of the wellbore or production tubing. As the gas flow decreases, for example due to reduced reservoir pressure from production of gas from the well, the gas no longer has enough energy to lift heavier liquids (e.g., water and longer chain molecules such as heptanes (C7) and larger molecules) to the surface. The mist-like drops of heavier fluids can coalesce together and form droplets on the inner wall of the wellbore or tubing and/or accumulate at the bottom of the well. Often the condensate is disturbed before appropriate logging tools for sampling or analysis are run in the wellbore. The systems and methods of this disclosure provide a way to collect samples of the condensate during the first run of a tool in the wellbore. The systems and methods of this disclosure also provide a way of sampling solid debris from the wellbore as the tool is pulled out of the wellbore.

Maturing reservoir wells over time can experience a reduction in tubing/casing internal diameter due to scale production and accumulation. A gauge cutter can be run through the wellbore to allow accessibility of tubing, casing, and liner for other tools to be run in the wellbore. Gauge cutters can come in different sizes. The size of gauge cutter chosen for a particular application can be dependent on, for example, the inner diameter of the wellbore, the diameter of subsequent tools to be used, or other factors. A gauge cutter can be used to tag the plug back total depth (PBTD), which is the depth of the well to the cement plug placed at the bottom of the producing zone (e.g., the accessible depth in the wellbore). A gauge cutter can also be used to clean a wellbore from soft paraffin and soft scale that has developed over time.

Figure 1C:
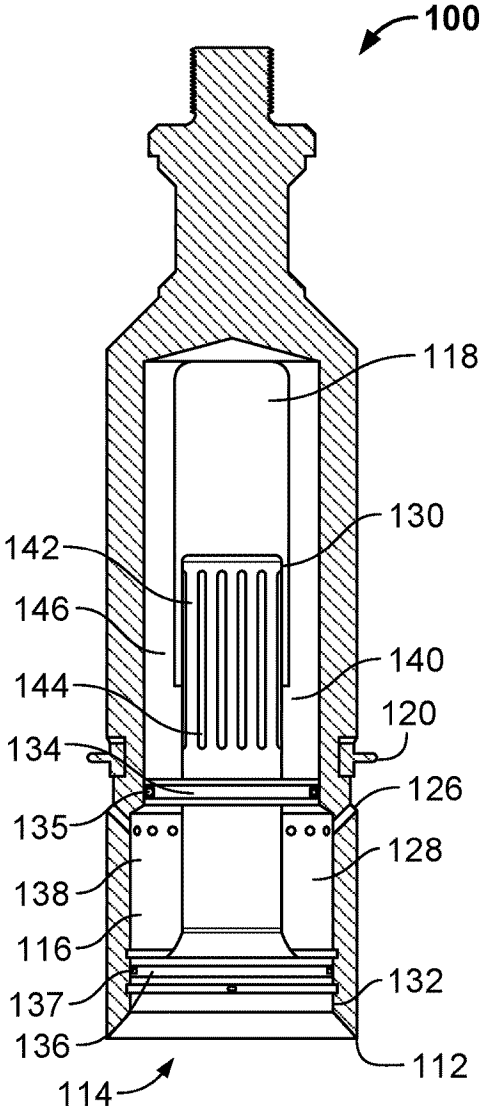
FIGS. 1A-1C show side, front, and cross section views of a gauge cutter configured to collect samples from a wellbore.
Figure 1B:
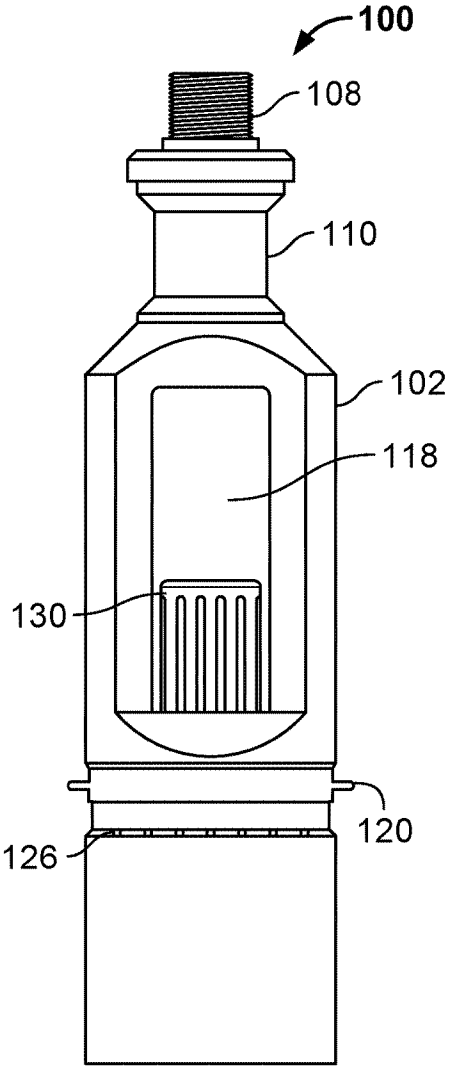
Figure 1A:
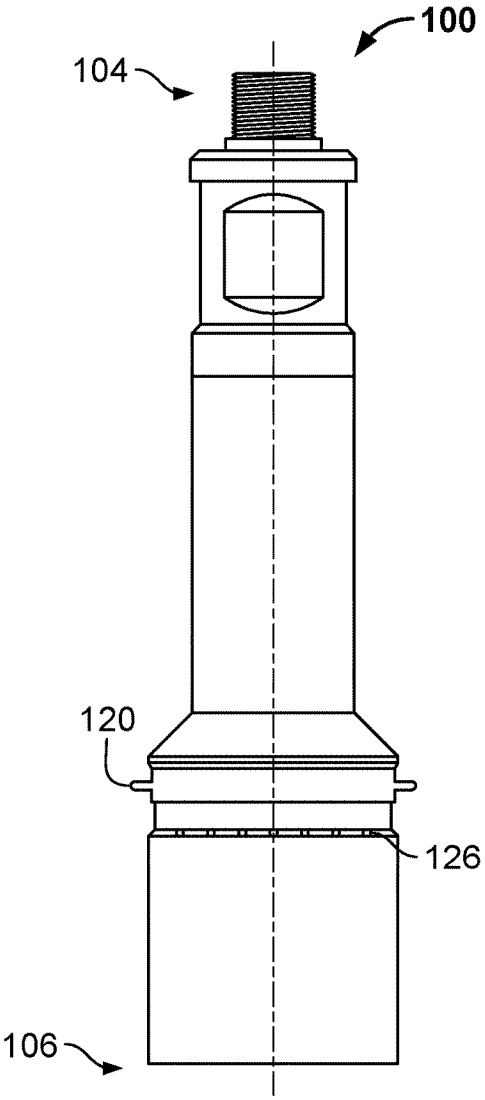

FIGS. 1A-1C show side, front, and section views of a gauge cutter 100 configured to collect samples from a wellbore. The gauge cutter 100 includes a cylindrical body 102 with an uphole end 104 and a downhole end 106. The uphole end 104 can include a standard wireline connection 108 and a fishing neck 110 to connect to a slickline. The downhole end 106 includes a cutter blade 112. The cutter blade 112 is configured to scrape cut, scour or dislodge debris from the interior walls of the wellbore. The cylindrical body 102 can be a single piece. A central recess 114 is defined within the cylindrical body 102 extending from the downhole end 106 toward the uphole end 104. The central recess 114 defines an interior wall 116 of the cylindrical body 102. One or more large openings 118 are defined in the cylindrical body 102 allowing access to the central recess 114 in the uphole portion of the central recess 114.

A wiper blade 120 is disposed around the exterior of the cylindrical body downhole from the large openings 118. The wiper blade 120 can include an elastomeric material or a plastic material. For example, the wiper blade can include polyurethane, silicone, fluoroelastomers, nitrile, polychloroprene, and ethylene propylene diene monomer (EPDM). The wiper blade 120 is configured to contact the interior walls of the wellbore and wipe condensate from the wellbore. The wiper blade can have an outer diameter larger than an outer diameter of the cylindrical body. The wiper blade can be flexible and configured to bend to allow the gauge cutter to pass through the wellbore. Condensate wiped from the wellbore can coalesce and pool on the downhole side of the wiper blade 120.

In some implementations, wiper blade 120 can include overlapping fingers or flaps. In these implementations, the wiper blade 120 can include a thin, flexible plastic, for example, polypropylene.

The cylindrical body 102 includes a plurality of passageways 126 extending from the exterior of the body 102 into the central recess 114. The plurality of passageways 126 is downhole from the wiper blade 120 and positioned to collect condensate wiped from the wellbore. The plurality of passageways 126 can be evenly spaced around the circumference of the cylindrical body 102. Each passageway 126 can have a small diameter (e.g., 0.05 mm, 1 mm, 2 mm). In some implementations, the plurality of passageways 126 can include passageways with different diameters. For example, a portion of the plurality of passageways 126 can have a diameter of 0.05 mm and a second portion of the plurality of passageways 126 can have a diameter of 2 mm. The plurality of passageways 126 can be capillary tubes configured to draw liquid from the exterior of the gauge cutter 100 to the central recess 114 using capillary forces between the liquid and the interior of the plurality of passageways 126. In some implementations, the liquid flows through the plurality of passageways 126 based on a pressure differential between a pressure exerted on condensate accumulated on the downhole side of the wiper blade 120 and the pressure inside the condensate collection chamber 128.

An annular condensate collection chamber 128 is disposed within the central recess 114 adjacent the interior wall 116 of the cylindrical body 102. The condensate collection chamber 128 is configured to collect condensate from the plurality of passageways 126. The condensate collection chamber 128 can be removable from the cylindrical body 102.

In some implementations, the condensate collection chamber 128 can be defined by a removable core 130 disposed within the central recess 114 of the gauge cutter 100. The removable core 130 can be made from plastic, metal, polymer, elastomer or combinations thereof. The removable core 130 can be attached to the cylindrical body 102 by a mechanical fastener 132, for example, a snap fit connection, magnetic connection, bolted connection, or tongue and groove connection. The removable core 130 includes an upper seal 134 and a lower seal 136. When inserted into the central recess 114, the removable core 130 defines an annular space 138 between the wall of the removable core 130 and the interior walls 116 of the cylindrical body 102. The annular space 138 is bounded in the uphole direction by the upper seal 134 and in the downhole direction by the lower seal 136. The annular space 138 can define the condensate collection chamber 128.

Uphole of the upper seal 134, a second annular space 140 is defined between the removable core 130 and the interior walls 116 of the cylindrical body 102. The uphole portion 142 of the removable core 130 includes slots 144 that are fluid permeable. In some implementations, the uphole portion 142 can include holes and/or a mesh instead of or in addition to slots 144. The second annular space 140 defines a solid debris collection chamber 146. When the gauge cutter 100 is pulled out of the wellbore, the solid collection chamber 146 can collect solid debris suspended in the fluid within the wellbore.

Figure 2C:
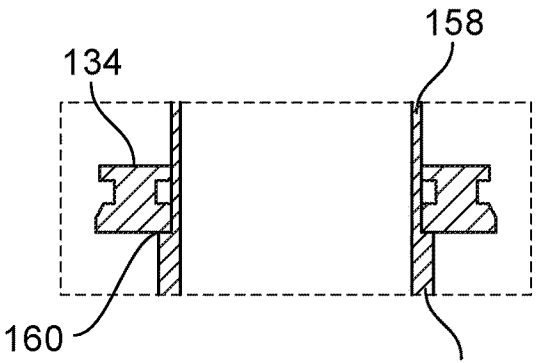
FIGS. 2A-2C show front, cross section, and detail views of a removable core for a gauge cutter to collect samples from a wellbore.
Figure 2B:
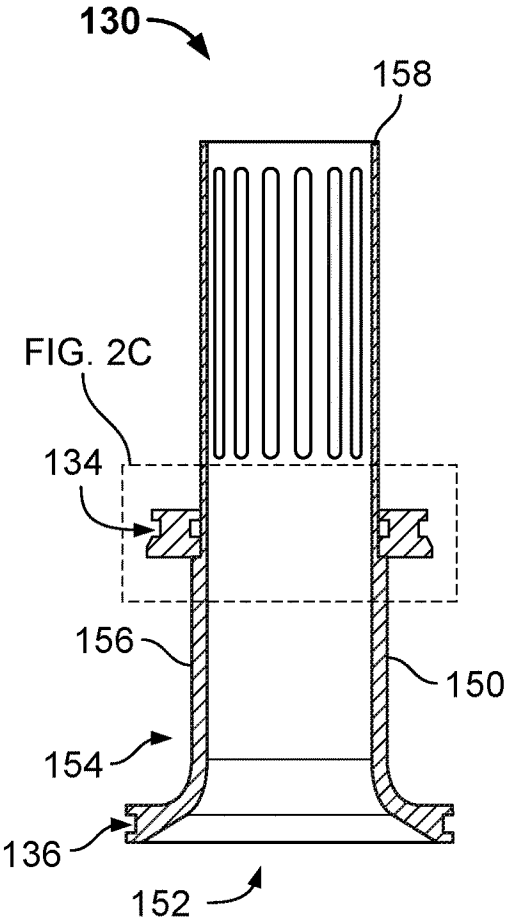
Figure 2A:
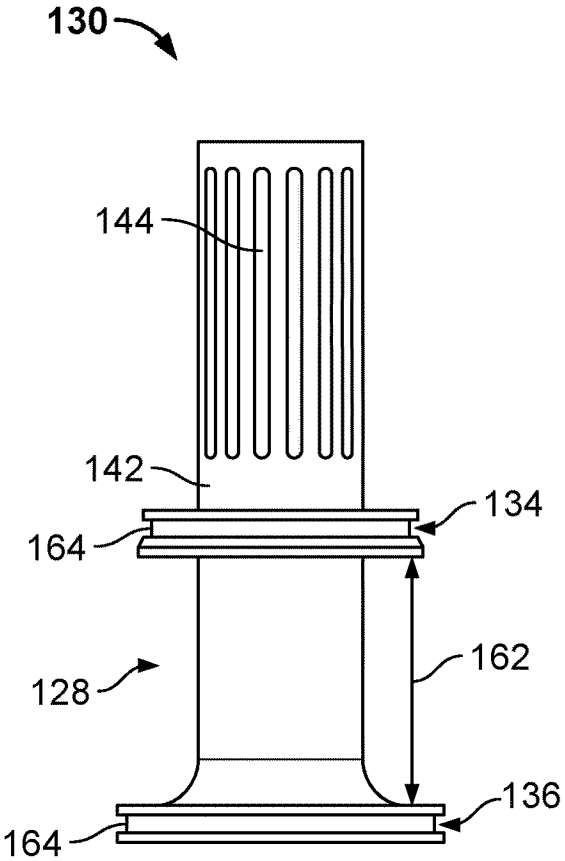

FIGS. 2A-2C show front, cross-section, and detail views of an example removable core 130. The removable core 130 includes a tubular core body 150 with an open central passageway 152 extending the entire length of the tubular core body 150. A downhole portion 154 of the tubular core body 150 can have a wall thickness 156 larger than a wall thickness 158 of the uphole portion 142. The upper seal 134 can rest on the shoulder 160 created by the difference in the wall thicknesses 156 and 158. The distance 162 between the lower seal 136 and the shoulder 160 defines the distance between the lower seal 136 and the upper seal 134. The distance 162 also defines the height of the condensate collection chamber 128. The surfaces of the downhole portion 154 of the tubular core body 150 are solid (e.g., no holes penetrate the walls of the downhole portion 154) and not permeable to fluids. The lower seal 136 can be integrated with the tubular core body 150. In some implementations, the lower seal 136 can be a separate piece fitted to the tubular core body 150. The upper seal 134 can be a separate piece from the tubular core body 150. The upper seal 134 and lower seal 136 can include a groove 164 where a gasket 135, 137 (e.g., an O-ring) can be positioned to form a fluid tight seal with the interior walls 116 of the gauge cutter 100.

Figure 3B:
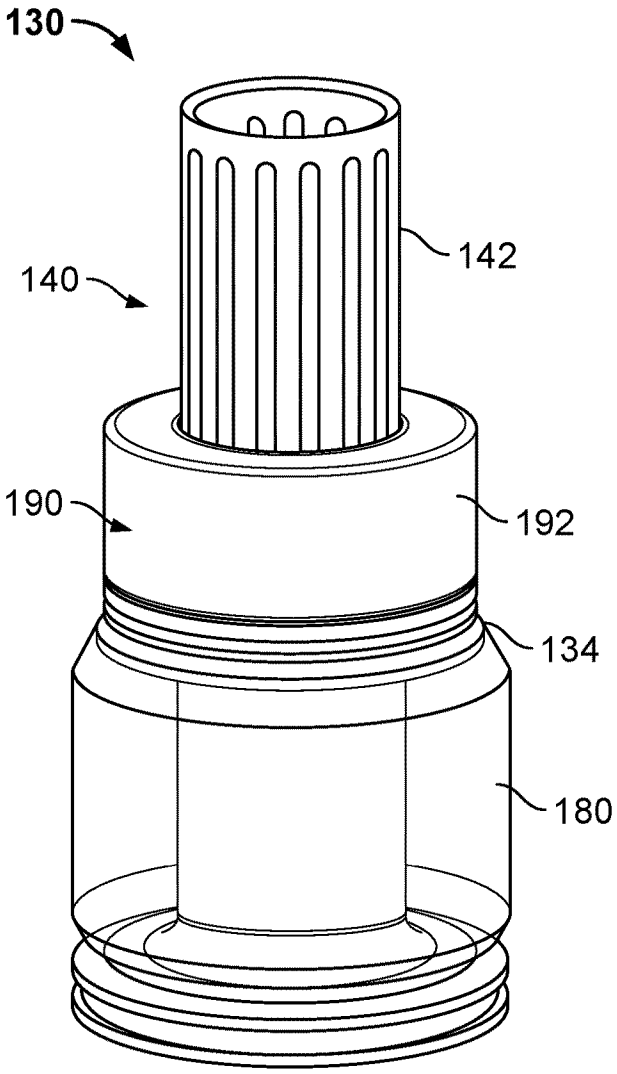
FIGS. 3A-3B show a gauge cutter to collect samples from a wellbore including a liquid collection sponge and a sensor module.
Figure 3A:
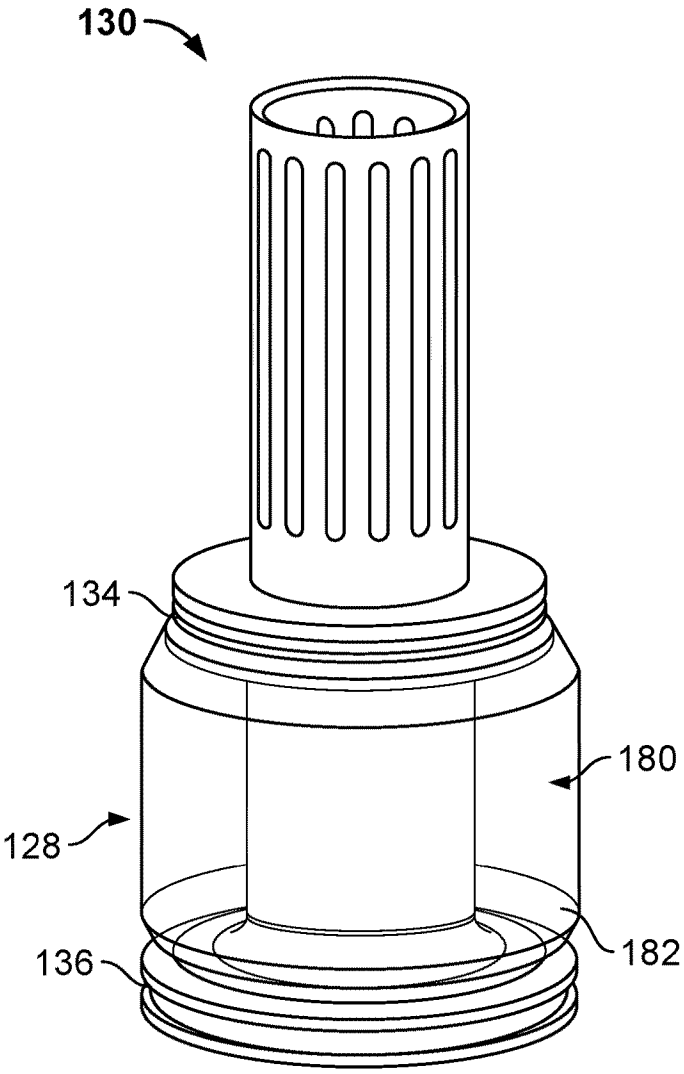

FIG. 3A illustrates an example liquid catching sponge 180 that can be included in some implementations. The liquid catching sponge 180 can be included in the condensate collection chamber 128. The sponge 180 can assist the retention and collection of condensate samples in the condensate collection chamber 128. In some implementations, a liquid catching sponge 180 can be made wettable to certain fluids. For example, the liquid catching sponge 180 can be oil wettable, or the sponge 180 can be water wettable. The type of sponge fitted into the condensate collection chamber 128 can be bespoke to a condensate expected to be or known to be within the wellbore. In some implementations, the liquid catching sponge 180 can include multiple types of wettable sponges. In these implementations, the liquid catching sponge 180 can be configured within the condensate collection chamber 128 such that the volume of different fluids collected can be estimated from the retrieved condensate samples. In some implementations, the bottom most part 182 of the liquid catching sponge 180 can collect liquid accumulated at the bottom of the well.

FIG. 3B illustrates an example sensor module 190 that can be included in some implementations. The sensor module 190 can include, for example, a fluid detection sensor, a water-cut sensor, a depth sensor, a pressure sensor, or a combination of sensors. The sensor module 190 can provide additional information on when and where condensate samples are collected during a running-in-hole (RIH) operation. The sensor module 190 can be housed in an annular housing 192 and can be disposed within the second annular space 140 uphole of the upper seal 134 surrounding the uphole portion 142 of the removable core 130.

The sensor module 190 can include a battery to provide power to the sensors of the sensor module. The sensor module 190 can also include a memory to store data and measurements detected by the sensors. The memory can be accessed, and data retrieved from the memory after the gauge cutter 100 is removed from the wellbore.

In some implementations, the sensor module 190 can be configured to start collection of condensate samples in the condensate collection chamber 128 at a pre-defined pressure or depth within the wellbore. In some implementations, a fluid detection sensor can be configured to detect concentrations of a particular fluid or multiple fluids (e.g., hydrogen sulfide, carbon dioxide, heptane).

Figure 4C:
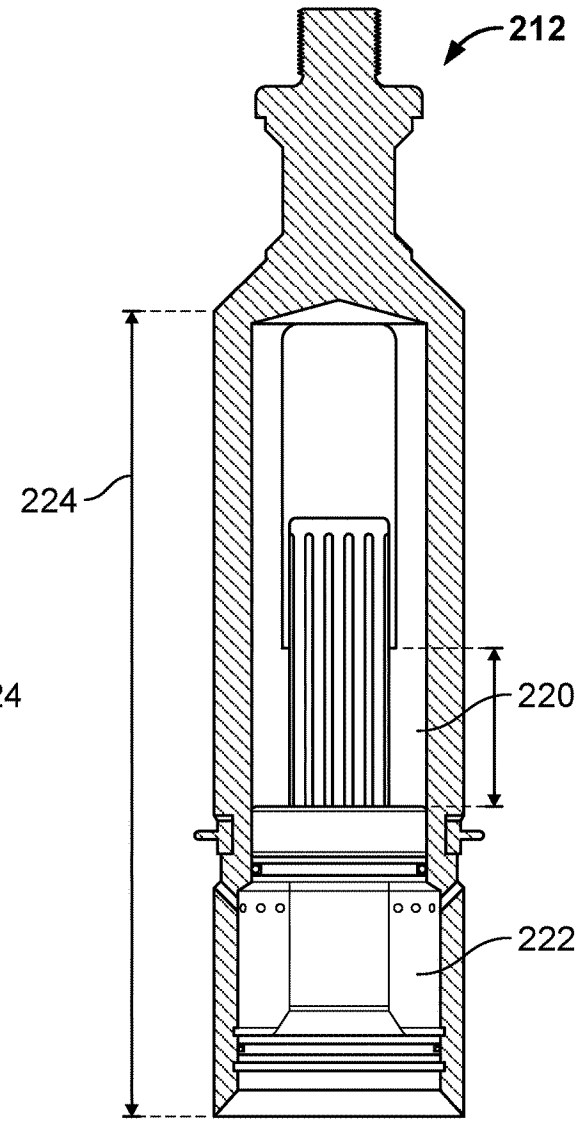
FIGS. 4A-4C shows a gauge cutter with liquid and solid collection chambers defined by the internal geometry of the gauge cutter.
Figure 4B:
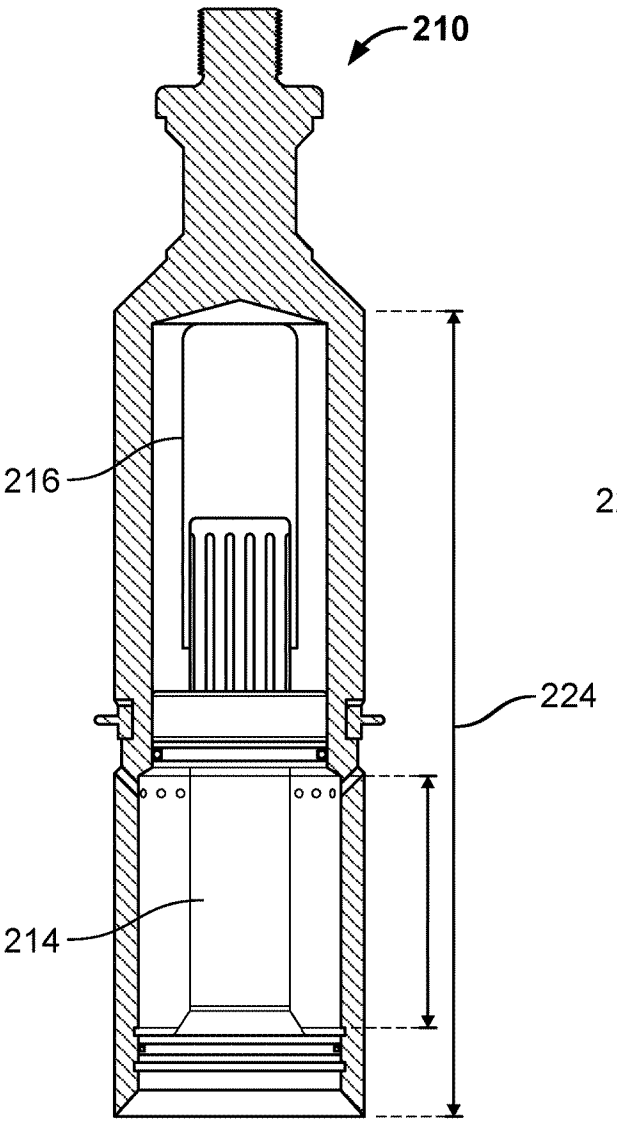
Figure 4A:
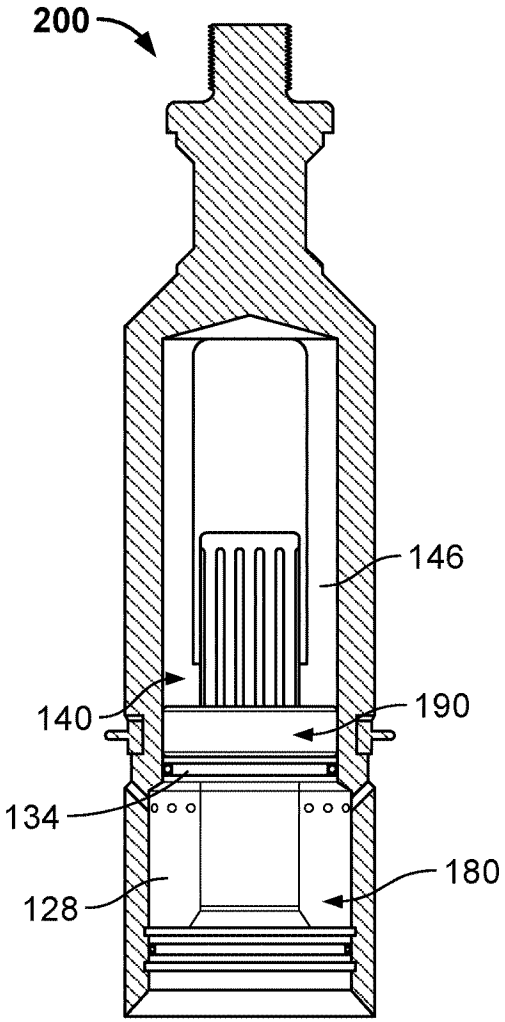

FIG. 4A illustrates a cross-section view of an example gauge cutter 200 including a sensor module 190 and a liquid catching sponge 180. The liquid catching sponge 180 is included within the condensate collection chamber 128. The sensor module 190 is included within the second annular space 140 uphole of the upper seal 134. The solid debris collection chamber 146 is uphole of the sensor module 190.

FIGS. 4B-4C show example configurations of gauge cutters 210, 212. Gauge cutters can be configured to match desired volumes for condensate collection and solid debris collection according to the specific application or wellbore without changing the overall design of the gauge cutter. FIG. 4B shows gauge cutter 210 which includes a longer condensate collection chamber 214 and a smaller solid debris collection chamber 216 as compared with gauge cutters 100 or 200. FIG. 4C illustrates a gauge cutter 212 that includes a larger solid debris collection chamber 220 and a smaller condensate collection chamber 222. In some implementations, the total length 224 of the gauge cutter 210 or 212 can remain the same while the lengths of the sample collection chambers are altered. In some implementations, the total length 224 of the gauge cutter and the lengths of the condensate and solid debris sample collection chambers can be customized without changing the tool functionality.

Figure 5:
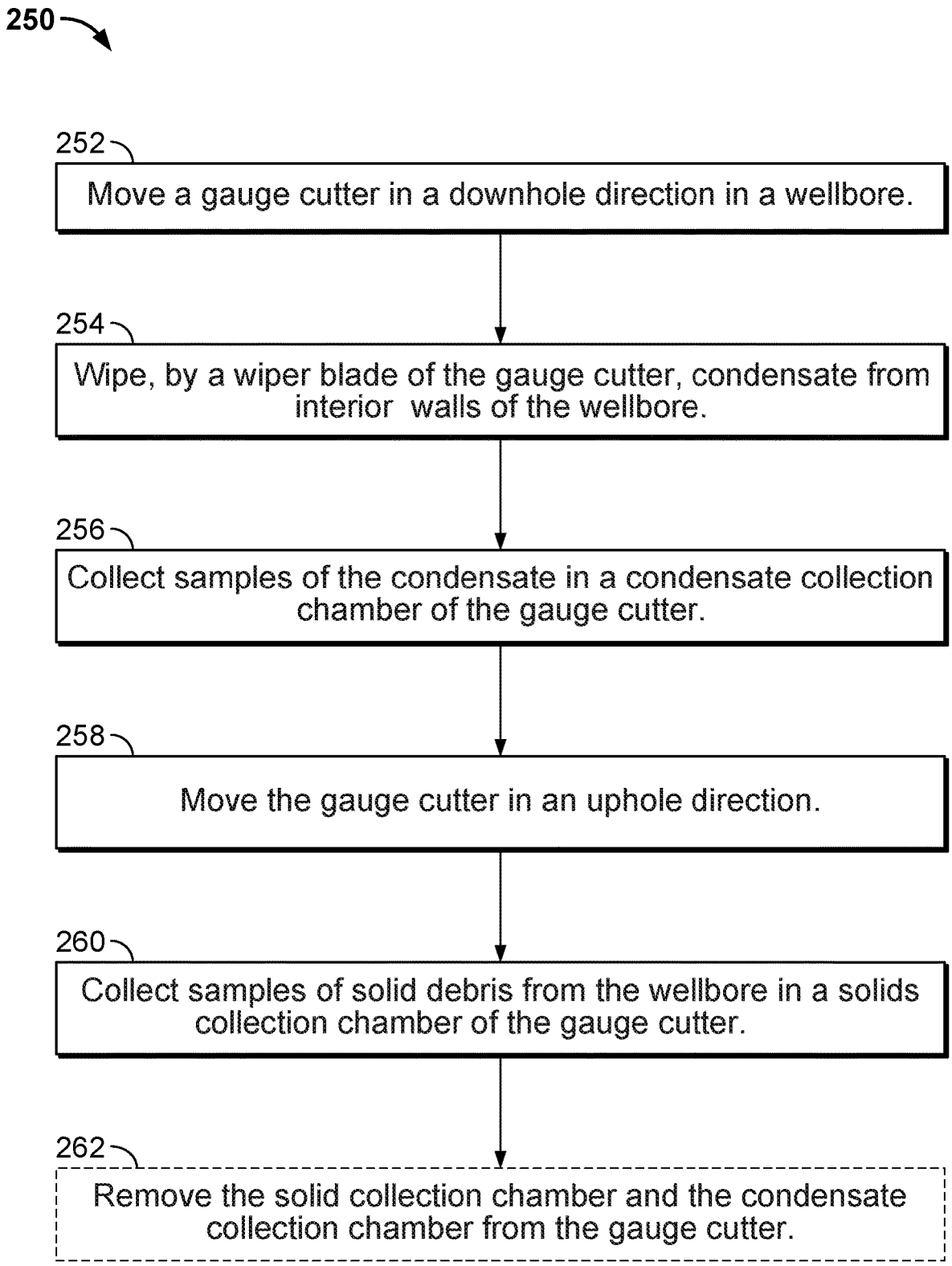
FIG. 5 is a flow chart of a method for collecting samples from a wellbore.

FIG. 5 is a flow chart of an example method 250 for collecting samples from a wellbore. The method 250 includes using a gauge cutter including a wiper blade disposed around the exterior circumference of the gauge cutter and a sample collection chamber interior to the gauge cutter (e.g., gauge cutter 100). The gauge cutter is moved in a downhole direction (252). The gauge cutter can be the first tool run in a wellbore to cut a clear path through debris (e.g., paraffin or scaling) that would otherwise prevent subsequent tools from being run through the wellbore. The sample collection chamber of the gauge cutter can include a condensate collection chamber and a solids collection chamber.

Condensate on interior walls of the wellbore is wiped by the wiper blade of the gauge cutter (254). Condensate (e.g., water and hydrocarbons) can form on the interior walls of the borehole. The condensate can be collected in a condensate collection chamber of the gauge cutter (256). In some implementations, the condensate collection can begin at a specified depth or pressure within the wellbore. In some implementations, a sensor module records locations and other properties (e.g., pressure) within the wellbore where condensate is collected. In some implementations, a sample of liquid from the bottom of the wellbore is collected in the condensate collection chamber. In some cases, the samples of condensate are retained by a liquid catching sponge disposed within the condensate collection chamber.

Figure 6:
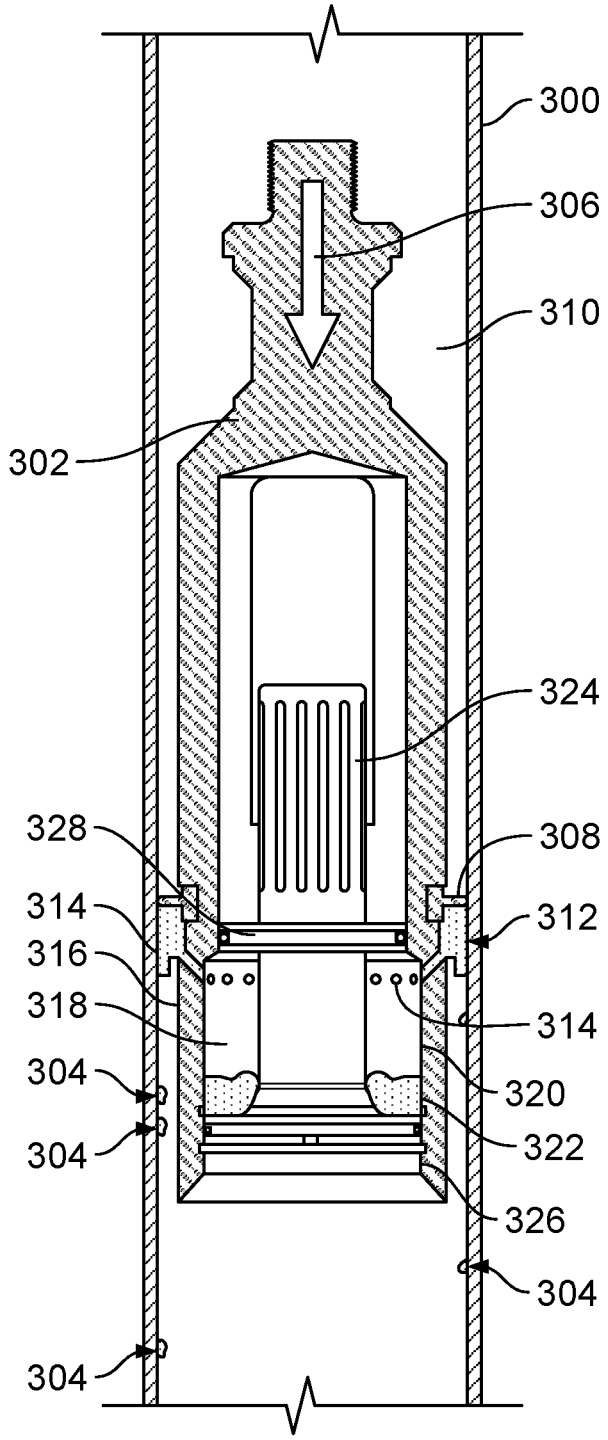
FIG. 6 illustrates condensate collections from a wellbore during a run of a gauge cutter.

FIG. 6 shows a cross section of a wellbore 300 and a gauge cutter 302 illustrating wiping of condensate 304 from the wellbore 300 while the gauge cutter 302 is moved in a downhole direction 306 (e.g., RIH). A wiper blade 308 of the gauge cutter 302 contacts the interior walls 310 of the wellbore 300. As the gauge cutter 302 moves downhole, condensate 304 that has formed on the interior walls 310 of the wellbore 300 accumulates in a pool 312 on the downhole side of the wiper blade 308. The pool 312 of condensate 304 can grow large enough to contact openings of passageways 314 that extend from the exterior 316 of the gauge cutter 302 into a condensate collection chamber 318 disposed adjacent the interior surface 320 of the gauge cutter 302. The passageways 314 can be capillary holes that draw the condensate 304 from the pool 312 of condensate into the condensate collection chamber 318. Within the condensate collection chamber 318, the collected condensate 322 pools in the bottom of the chamber. In some implementations, the condensate collection chamber 318 is formed between the surface of a removable core 324 and the interior walls 320 of the gauge cutter 302. A lower seal 326 and an upper seal 328 prevent leakage of the collected condensate 322 out of the condensate collection chamber 318. The lower seal 326 and upper seal 328 also prevent contamination of the collected condensate 322 by other fluids present in the wellbore. Since the gauge cutter 302 is the first tool run in the wellbore 300 during an intervention, the probability of obtaining a sample of condensate 304 is higher than for subsequent intervention tool runs because the well and condensate have not been disturbed.

In some implementations, the openings of the passageways 314 can become blocked by solid debris from the interior walls 310 of the wellbore 300. Multiple passageways can be provided in the body of the gauge cutter 302 to increase the likelihood of sampling condensate 304 in the wellbore 300. After retrieval of the gauge cutter 302 from the wellbore 300, debris blocking the passageways 314 can be removed and analyzed to provide additional insight into the behavior of the well or reservoir.

Figure 7A:
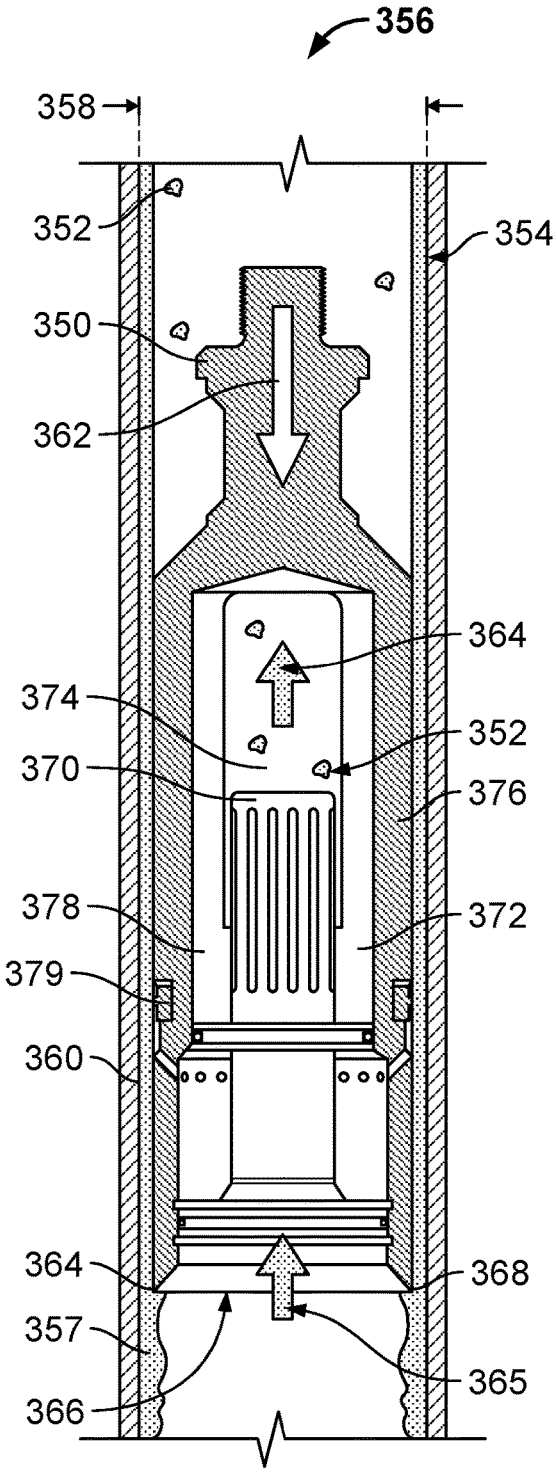
FIGS. 7A-7B illustrate collection of solid samples from a wellbore during run-in-hole and pull-out-of-hole.

FIG. 7A illustrates a cross section of a gauge cutter 350 removing solid debris 352 from the interior walls 354 of a wellbore 356. Solid debris 352 (e.g., scale and paraffin) can accumulate on the interior walls 354 of the wellbore 356 decreasing the internal diameter 358 of the wellbore 356. A function of the gauge cutter 350 is to define a known passage diameter within the wellbore 356. In the event of the formation of scale 357, the gauge cutter 350 can be forced through the scale 357 cutting the known passage diameter (e.g., the external diameter 360 of the gauge cutter). As the gauge cutter 350 is moved in a downhole direction 362 (e.g., RIH), the cutter blade 364 scrapes, cuts, and/or dislodges the solid debris 352 forming a clear path through the wellbore 356 of the diameter 360 of the gauge cutter 350. The solid debris 352 that is removed from the wellbore 356 and fluid 365 within the wellbore 356 can move in an uphole direction relative to the gauge cutter 350. The solid debris 352 and fluid can pass through the open aperture 366 in the downhole end 368 of the removable core 370 and central recess 372 of the gauge cutter 350. The solid debris 352 and fluid can exit the central recess 372 through the large openings 374 in the uphole portion 376 of the gauge cutter 350 bypassing the solid debris collection chamber 378. In this scenario the wiper blade 379 installed around the external diameter 360 of the gauge cutter 350 can fold backwards (e.g., in an uphole direction) providing a low resistance to pushing the gauge cutter 350 through the scale deposits on the interior walls 354 of the wellbore 356 during RIH operations. The gauge cutter 350 can simultaneously collect condensate samples as discussed with reference to FIG. 6.

Turning back to method 250 in FIG. 5, the gauge cutter can be moved in an uphole direction, for example, while being pulled out of the hole (POOH) (258). The gauge cutter can collect samples of solid debris in a solids collection chamber of the gauge cutter (260). For example, in gauge cutter 100, solid debris can be collected in the solids collection chamber 146 formed by the annular space 140 between the removable core 130 and the interior walls 116 of the gauge cutter. The solid debris collection chamber collects a small portion of the solid debris within the wellbore. For example, the solid collection chamber can collect 50 grams to 1000 grams of solid debris. The amount of solid debris collected depends on the volume of the solid debris collection chamber. For example, the solid debris collection chamber can have a volume of 0.3 L to 1 L. Other solid debris collection chambers can have other volumes (e.g., a volume of 0.1 L to 1.5 L).

Samples collected in the wellbore can be removed from the gauge cutter by removing the solid debris collection chamber and the condensate collection chamber from the gauge cutter (262). In some implementations, the collected samples are packaged for transportation to a laboratory facility where further analysis and measurements are performed. In some implementations, analysis and measurements of the collected samples can be performed at the well site.

Example analysis that can be performed on the collected samples include separating liquid hydrocarbons from water mechanically (e.g., using a centrifuge) or chemically (e.g., using a demulsifier). The fraction of different long-chain alkanes like heptanes, octanes, nonanes within the liquid hydrocarbon phase can be characterized using a gas chromatograph. A detailed breakdown of the composition of liquid in the well bore can help in mitigating future flow assurance issues. For example, an operator can decide between several actions depending on the known composition of liquid in the wellbore. Example actions include applying a different choke setting at the surface to produce less liquid, deciding to inject scale inhibitors, and boosting reservoir pressure by water injection.

Figure 7B:
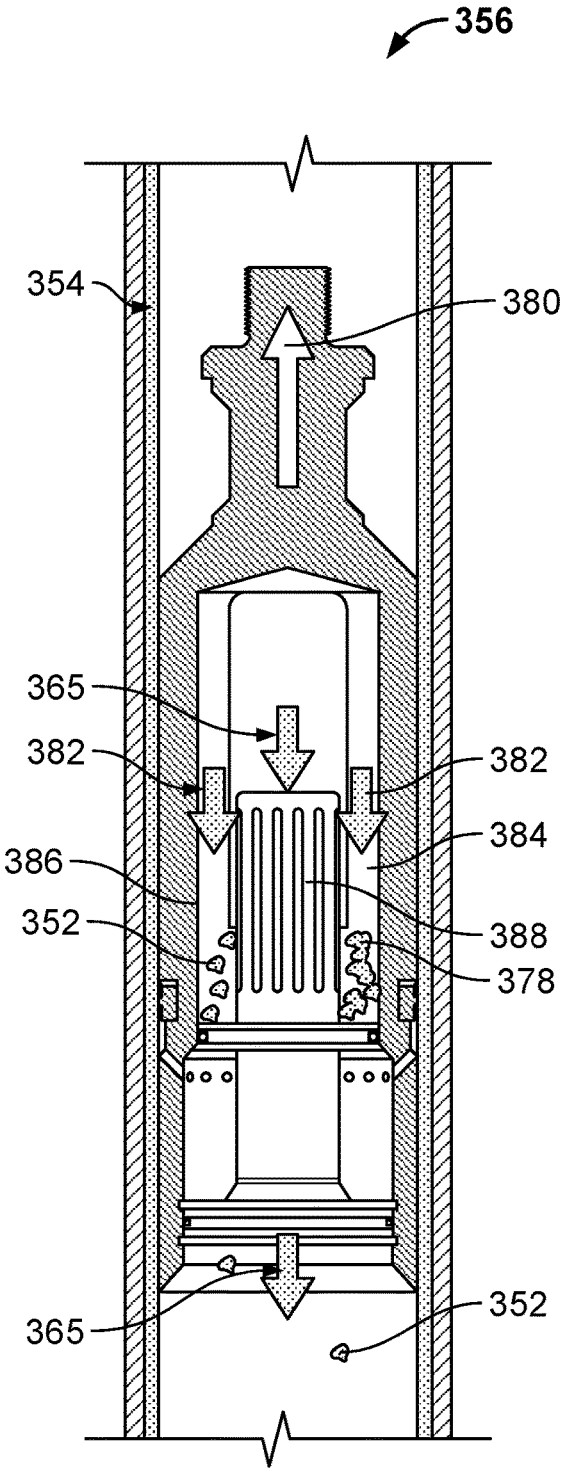

FIG. 7B illustrates the collection of solid debris 352 when the gauge cutter 350 is pulled out of hole (POOH) (e.g., moving the gauge cutter 350 in an uphole direction 380). Fluid 365 and entrained and/or suspended solid debris 352 enter the central recess 372 of the gauge cutter 350 through the large openings 374 and exit through the open aperture 366 in the downhole end 368. A portion of the fluid 382 flows into the second annular space 384 between the interior walls 386 of the gauge cutter 350 and the removable core 370. The portion of fluid 382 can flow into the second annular space 384, through the slots 388 in the removable core 370, and exit the central recess 372 through the open aperture 366 in the downhole end 368 of the gauge cutter 350. Solid debris 352 entrained in the portion of fluid 382 that is larger than the width of the slots 388 in the removable core 370 can be retained in the annular space 384 and settle into the solid debris collection chamber 378. The solid debris collection chamber 378 can collect solid debris 352 until the solid debris collection chamber is full. After filling the solid debris collection chamber 378, the fluid 365 within the wellbore can continue to flow through the open aperture 366 in the removable core 370. Entrained solid debris 352 can follow the fluid path 365 and exit the gauge cutter 350 through the open aperture 366 in the downhole end 368.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A gauge cutter comprising:

a body comprising:

a central recess in a downhole end of the body extending toward an uphole portion of the body;

one or more openings in the uphole portion of the body extending from an exterior of the body into the central recess;

a cutter blade disposed at the downhole end of the body;

a fluid collection chamber disposed within the central recess and adjacent an interior surface of the body;

a wiper blade disposed around an exterior of the body; and a plurality of passageways downhole and adjacent the wiper blade configured to allow fluid to pass from the exterior of the body into the fluid collection chamber.

2. The gauge cutter of claim 1, further comprising a solid debris sample collector disposed within the central recess.

3. The gauge cutter of claim 1, further comprising a removable core with an upper seal and a lower seal.

4. The gauge cutter of claim 3, wherein an annular space between the removable core, the upper seal, the lower seal, and the interior surface of the body define the fluid collection chamber.

5. The gauge cutter of claim 1, further comprising a sensor module comprising an annular housing and positioned adjacent the fluid collection chamber.

6. The gauge cutter of claim 5, wherein the sensor module comprises at least one of a fluid detection sensor, a water-cut sensor, a depth sensor, and a pressure sensor.

7. The gauge cutter of claim 5, wherein the sensor module is configured to allow collection of fluid in the fluid collection chamber based on a sensed pressure or depth in a wellbore.

8. The gauge cutter of claim 1, wherein the wiper comprises an elastomeric material.

9. The gauge cutter of claim 1, wherein the plurality of passageways comprises capillary tubes.

10. A gauge cutter comprising:

a body comprising:

a central recess in a downhole end of the body extending toward an uphole portion of the body;

one or more openings in the uphole portion of the body extending from an exterior of the body into the central recess;

a cutter blade disposed at the downhole end of the body;

a fluid collection chamber disposed within the central recess and adjacent an interior surface of the body;

a wiper blade disposed around an exterior of the body;

a plurality of passageways downhole and adjacent the wiper blade configured to allow fluid to pass from the exterior of the body into the fluid collection chamber; and a liquid collecting sponge.

11. The gauge cutter of claim 10, wherein the liquid collecting sponge comprises an oil wettable sponge.

12. A method of collecting samples from a wellbore comprising:

moving a gauge cutter in a downhole direction in the wellbore;

wiping, by a wiper blade of the gauge cutter, condensate from interior walls of the wellbore;

collecting samples of the condensate in a condensate collection chamber of the gauge cutter;

moving the gauge cutter in an uphole direction in the wellbore; and collecting samples of solid debris from the wellbore in a solids collection chamber of the gauge cutter.

13. The method of claim 12, further comprising removing the solid collection chamber and the condensation collection chamber from the gauge cutter to access the collected samples.

14. The method of claim 12, further comprising measuring at least one of a pressure, a depth, and a presence of a liquid in the wellbore by a sensing module of the gauge cutter.

15. The method of claim 14, wherein collecting samples of the condensate occurs after the sensing module measures a pre-defined pressure or depth in the wellbore.

16. The method of claim 12, wherein while moving the gauge cutter in the downhole direction, solid debris passes through the gauge cutter without being collected.

17. The method of claim 12, wherein wiping comprises condensate pooling on a downhole side of the wiper blade.

18. The method of claim 12, wherein collecting samples of the condensate comprises condensate flowing through a plurality of passageways of the gauge cutter from an exterior of the gauge cutter into the condensate collection chamber.

19. The method of claim 18, further comprising retaining condensate in a liquid catching sponge disposed within the condensate collection chamber.

20. The method of claim 12, further comprising collecting a sample of liquid located at a bottom of the wellbore.

* * * * *